US008073145B2

(12) United States Patent
Kondo et al.

(10) Patent No.: US 8,073,145 B2
(45) Date of Patent: Dec. 6, 2011

(54) METHOD AND APPARATUS FOR SEPARATING SOUND-SOURCE SIGNAL AND METHOD AND DEVICE FOR DETECTING PITCH

(75) Inventors: Tetsujiro Kondo, Tokyo (JP); Akihiko Arimitsu, Kanagawa (JP); Hiroshi Ichiki, Kanagawa (JP); Junichi Shima, Kanagawa (JP)

(73) Assignee: Sony Corporation (JP)

( * ) Notice: Subject to any disclaimer, the term of this patent is extended or adjusted under 35 U.S.C. 154(b) by 1414 days.

(21) Appl. No.: 11/060,346

(22) Filed: Feb. 17, 2005

(65) Prior Publication Data

US 2005/0195990 A1 Sep. 8, 2005

(30) Foreign Application Priority Data

Feb. 20, 2004 (JP) ..... P2004-045237
Feb. 20, 2004 (JP) ..... P2004-045238

(51) Int. Cl.
*H04R 29/00* (2006.01)
*H04R 3/00* (2006.01)
*G10L 11/04* (2006.01)

(52) U.S. Cl. ..... 381/56; 381/92; 381/122; 704/207

(58) Field of Classification Search ..... 381/1, 92, 381/56, 61, 122; 704/207
See application file for complete search history.

(56) References Cited

U.S. PATENT DOCUMENTS 3,644,674 A * 2/1972 Mitchell et al. ..... 379/392
4,044,204 A * 8/1977 Wolnowsky et al. ..... 704/208
5,694,474 A 12/1997 Ngo et al.
6,885,986 B1 4/2005 Gigi
2004/0170293 A1 9/2004 Watson et al.

FOREIGN PATENT DOCUMENTS

JP 07-028492 A 1/1995
JP 10191290 A 7/1998
JP 11508105 T 7/1999
JP 2000-181499 A 6/2000
JP 2001-222289 A 8/2001
JP 2002-515609 T 5/2002
JP 2003-515281 T 4/2003
JP 2003108200 A 4/2003
JP 2003280696 A 10/2003
WO WO-01/13360 A1 2/2001

OTHER PUBLICATIONS

Liu, C. et al., "A Targeting-and-Extracting Technique to Enhance Hearing in the Presence of Competing Speech", Journal of the Acoustical Society of America, vol. 101, No. 5, Part 1, May 1997, pp. 2877-2891.
Zerubia, J. et al., "Using Synchronous Averaging to Enhance Noisy Speech", Proceedings of Internoise, Sep. 1987, pp. 1053-1056.
Office Action from Japanese Application No. 2005-041169, dated Jun. 29, 2010.

* cited by examiner

*Primary Examiner* — Vivian Chin
*Assistant Examiner* — Douglas Suthers
(74) *Attorney, Agent, or Firm* — Lerner, David, Littenberg, Krumholz & Mentlik, LLP

(57) ABSTRACT

In a sound-source signal separating method, a target sound-source signal in an input audio signal is enhanced, the input audio signal being from a mixture of acoustic signals from a plurality of sound sources picked up by a plurality of sound pickup devices. The pitch of the target sound-source signal in the input audio signal is detected, and the target sound-source signal is separated from the input audio signal based on the detected pitch and the enhanced sound-source signal.

14 Claims, 26 Drawing Sheets

FIG. 11A
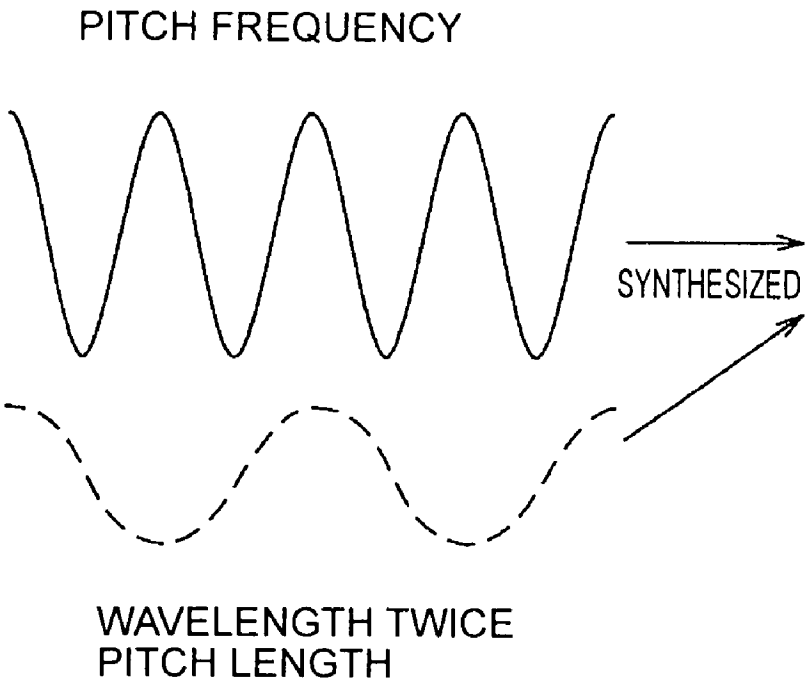
FIG. 11B
FIG. 11C
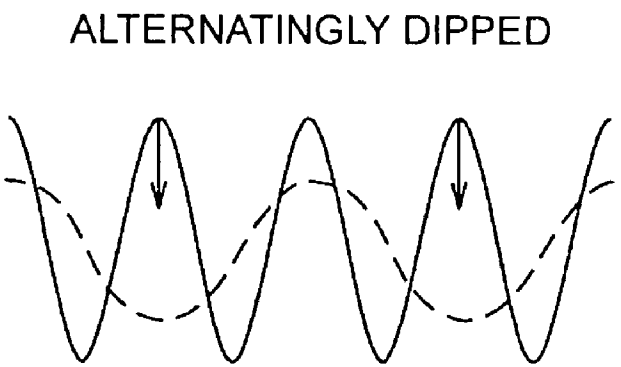
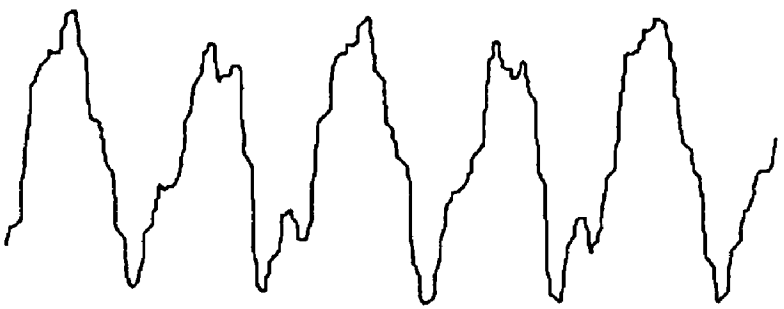
FIG. 11D

FIG. 14

| | VALUE OF Ty | RATIO r | FLAG |
|---|---|---|---|
| Ty (1) | 151 | | |
| Ty (2) | 152 | 1.00 | 1 |
| Ty (3) | 148 | 0.97 | 1 |
| Ty (4) | 149 | 1.00 | 1 |
| Ty (5) | 153 | 1.02 | 1 |
| Ty (6) | 152 | 0.99 | 1 |
| ⋮ | ⋮ | ⋮ | ⋮ |
| Ty (n) | 149 | 0.7 | 0 |
| Ty (n+1) | 180 | 1.2 | 0 |
| Ty (n+2) | 101 | 0.56 | 0 |

METHOD AND APPARATUS FOR SEPARATING SOUND-SOURCE SIGNAL AND METHOD AND DEVICE FOR DETECTING PITCH

CROSS-REFERENCE TO RELATED APPLICATIONS

The present application claims priority from Japanese Application Nos. 2004-045237 filed Feb. 20, 2004 and 2004-045238 filed Feb. 20, 2004, the disclosures of which are hereby incorporated by reference herein.

BACKGROUND OF THE INVENTION

The present invention relates to a method and an apparatus for separating a sound-source signal and a method and a device for detecting the pitch of the sound-source signal. More particularly, the present invention relates to a method and an apparatus for separating one audio signal from among audio signals from a plurality of sound sources with stereomicrophones, and a method and a device for detecting the pitch of the audio signal.

Techniques for separating a target sound-source signal from an audio signal that is a mixture of a plurality of sound-source signals are known. For example, as shown in FIG. 26, voices emitted from three persons SPA, SPB, and SPC are picked up by acoustic to electrical conversion means, such as left and right stereomicrophones MCL and MCR, as an audio signal, and an audio signal from a target person is separated from the picked up audio signal.

For example, Japanese Unexamined Patent Application Publication No. 2001-222289 discloses one of the known sound-source signal separating techniques which utilizes an audio signal separating circuit and a microphone employing the audio signal separating circuit. In the disclosed technique, a plurality of mixed signals, each mixed signal containing the linear sum of a plurality of mutually independent linear sound-source signals, are frame divided, and the inverses of mixed matrices that minimize correlation of a plurality of signals separated by the separating circuit in connection with zero lag time are multiplied by each other on a per frame basis. An original voice signal is thus separated from the mixed signal.

Japanese Unexamined Patent Application Publication No. 7-28492 discloses a sound-source signal estimating device for estimating a target sound source. The sound-source signal estimating device is intended for use in extracting a target audio signal under a noisy environment.

The pitch of a target sound is determined to separate a sound-source signal. As a technique to detect pitch, Japanese Unexamined Patent Application Publication No. 2000-181499 discloses an audio signal analysis method, an audio signal analysis device, an audio signal processing method and an audio signal processing apparatus. According to the disclosure, an input signal having a predetermined duration of time is sliced every frame, a frequency analysis is performed for each frame, and a harmonic component assessment is performed based on the result of the frequency analysis for each frame. A harmonic component assessment is performed on the inter-frame difference in the amplitudes in the results of frequency analysis for each frame. The pitch of the input signal is thus detected using the result of the harmonic component assessment.

Microphones more in number than the sound sources are required to separate a plurality of sound-source signals. The use of a plurality of microphones is actually being studied.

For example, Japanese Unexamined Patent Application Publication No. 2001-222289 discloses that separating a sound-source signal from three or more sound-sources using two microphones is difficult. Japanese Unexamined Patent Application Publication No. 7-28492 discloses a technique to extract an audio signal from a target sound source using a plurality of microphones (a microphone array). According to these disclosed techniques, more microphones than the number of sound sources are required to separate a target sound-source signal from a mixed signal of a plurality of sound-source signals.

In accordance with known techniques, stereomicrophones used in a mobile audio-visual (AV) device, such as a video camera, have difficulty in separating three or more sound-source signals.

When the pitch of a target sound is determined prior to the separation of the sound-source signals, the pitch detection is preferably appropriate for the separation of the sound-source signals.

SUMMARY OF THE INVENTION

Accordingly, it is an object of the present invention to provide a sound-source signal separating apparatus, a sound-source signal separating method, a pitch detecting device, and a pitch detecting method for picking up audio signals (typically acoustic signals) from a plurality of sound sources using a small number of sound pickup devices, such as stereomicrophones, and separating an audio signal of a target sound source.

According to a first aspect of the present invention, a sound-source signal separating apparatus includes a sound-source signal enhancing unit operable to enhance a target sound-source signal in an input audio signal to produce an enhanced sound-source signal, the input audio signal including a mixture of acoustic signals from a plurality of sound sources picked up by a plurality of sound pickup devices; a pitch detector operable to detect a pitch of the target sound-source signal in the input audio signal; and a sound-source signal separating unit operable to separate the target sound-source signal from the input audio signal based on the detected pitch and the enhanced sound-source signal.

The sound-source signal separating unit preferably includes a filter for separating the target sound-source signal from a signal output from the sound-source signal enhancing unit; and a filter coefficient output unit operable to output a filter coefficient of the filter based on information detected by the pitch detector.

The filter coefficient preferably features a frequency characteristic of the filter which causes a frequency component to pass through the filter, the frequency component having a frequency which is an integer multiple of the pitch frequency of the target sound-source signal.

The filter coefficient output unit preferably includes a memory storing filter coefficients corresponding to a plurality of pitches, the filter coefficient output unit reading and outputting a filter coefficient from the memory corresponding to the pitch of the target sound-source signal.

The sound-source signal separating apparatus further includes a high-frequency region processing unit operable to process a portion of the output signal in a consonant band; and a filter bank operable to extract the portion of the output signal in the consonant band from the sound-source signal enhancing unit and to transfer the portion of the output signal in the consonant band to the high-frequency region processing unit, to extract a portion of the output signal in a band other than the consonant band from the sound-source signal enhancing unit and to transfer the portion of the output signal in the band other than the consonant band to the filter, and to extract a portion of the output signal in a vowel band from the sound-source signal enhancing unit and to transfer the portion of the output signal in the vowel band to the pitch detector.

The plurality of sound pickup devices preferably include a left stereomicrophone and a right stereomicrophone.

The sound-source signal enhancing unit preferably corrects the audio signals from the plurality of sound pickup devices with a time difference between sound propagation delays, each sound propagation delay being measured from a target sound source to each of the plurality of sound pickup devices, and adds the corrected acoustic signals from the plurality of sound pickup devices in order to enhance the acoustic signal from only the target sound source. The pitch detector preferably detects the pitch of the target sound-source signal using two wavelengths of the pitch of the target sound-source signal as a unit of detection.

The sound-source signal separating unit preferably includes a fundamental waveform producing unit operable to produce a fundamental waveform based on information detected by the pitch detector using a steady portion of a signal output from the sound-source signal enhancing unit, the steady portion having the same or about the same pitch consecutively repeated throughout; and a fundamental waveform substituting unit operable to substitute a repetition of the fundamental waveform produced by the fundamental waveform producing unit for at least a portion of a signal based on the input audio signal.

Preferably, the pitch detector detects the pitch of the target sound-source signal using two wavelengths of the pitch of the target sound-source signal as a unit of detection. The plurality of sound pickup devices preferably includes a left stereomicrophone and a right stereomicrophone.

Preferably, the sound-source signal enhancing unit corrects the acoustic signals from the plurality of sound pickup devices with a time difference between sound propagation delays, each sound propagation delay being measured from a target sound source to each of the plurality of sound pickup devices, and adds the corrected acoustic signals from the plurality of sound pickup devices in order to enhance the acoustic signal from only the target sound source.

The fundamental waveform producing unit preferably averages the target sound-source signal in a steady portion of the target sound-source signal having the same or about the same pitch consecutively repeated throughout using two wavelengths of the pitch as a unit of detection.

According to a second aspect of the present invention, a sound-source signal separating method includes enhancing a target sound-source signal in an input audio signal to produce an enhanced sound-source signal, the input audio signal including a mixture of acoustic signals from a plurality of sound sources picked up by a plurality of sound pickup devices; detecting a pitch of the target sound-source signal in the input audio signal; and separating the target sound-signal from the input audio signal based on the detected pitch and the enhanced sound-source signal.

According to a third aspect, a pitch detector includes a sound-source signal enhancing unit operable to enhance a target sound-source signal in an input audio signal to produce an enhanced sound-source signal, the input audio signal including a mixture of acoustic signals from a plurality of sound sources picked up by a plurality of sound pickup devices; a period detector operable to detect a two-wavelength period of a signal output from the sound-source signal enhancing unit using two wavelengths of a pitch of the output signal as a unit of detection; and a continuity determining unit operable to determine, in response to a change in the two-wavelength period detected by the period detector, whether the same or about the same pitch has been consecutively repeated, and to output pitch information as the result of the determination.

The plurality of sound pickup devices preferably include a left stereomicrophone and a right stereomicrophone. The sound-source signal enhancing unit preferably corrects the acoustic signals from the plurality of sound pickup devices with a time difference between sound propagation delays, each sound propagation delay being measured from a target sound source to each of the plurality of sound pickup devices, and adds the corrected acoustic signals from the plurality of sound pickup devices in order to enhance the acoustic signal from only the target sound source.

According to a fourth aspect of the present invention, a pitch detecting method includes enhancing a target sound-source signal in an input audio signal to produce an enhanced sound-source signal, the input audio signal including a mixture of acoustic signals from a plurality of sound sources picked up by a plurality of sound pickup devices; detecting a two-wavelength period of a signal output from the sound-source signal enhancing step using two wavelengths of a pitch of the output signal as a unit of detection; and determining, in response to a change in the two-wavelength period detected in the period detecting step, whether about the same pitch has been consecutively repeated, and outputting pitch information as the result of the determination.

According to a fifth aspect of the present invention, a sound-source signal separating apparatus includes a pitch detector operable to detect a pitch of a target sound-source signal of an input audio signal using a wavelength twice the pitch of the target sound-source signal as a unit of detection, the input audio signal including a mixture of acoustic signals from a plurality of sound sources; and a sound-source signal separating unit operable to separate the target sound-source signal based on the detected pitch.

According to a sixth aspect of the present invention, a sound-source signal separating method includes detecting a pitch of a target sound-source signal of an input audio signal using a wavelength twice the pitch of the target sound-source signal as a unit of detection, the input audio signal including a mixture of acoustic signals from a plurality of sound sources; and separating the target sound-source signal based on the detected pitch.

BRIEF DESCRIPTION OF THE DRAWINGS

FIGS. 11A-11D illustrate an audio signal waveform illustrating the reason why pitch detection is performed with two wavelengths serving as a unit of detection;

FIG. 14 lists information obtained every pitch detection unit, the pitch detection unit being two wavelengths;

DETAILED DESCRIPTION

The embodiments of the present invention are described below with reference to the drawings.

Figure 1:
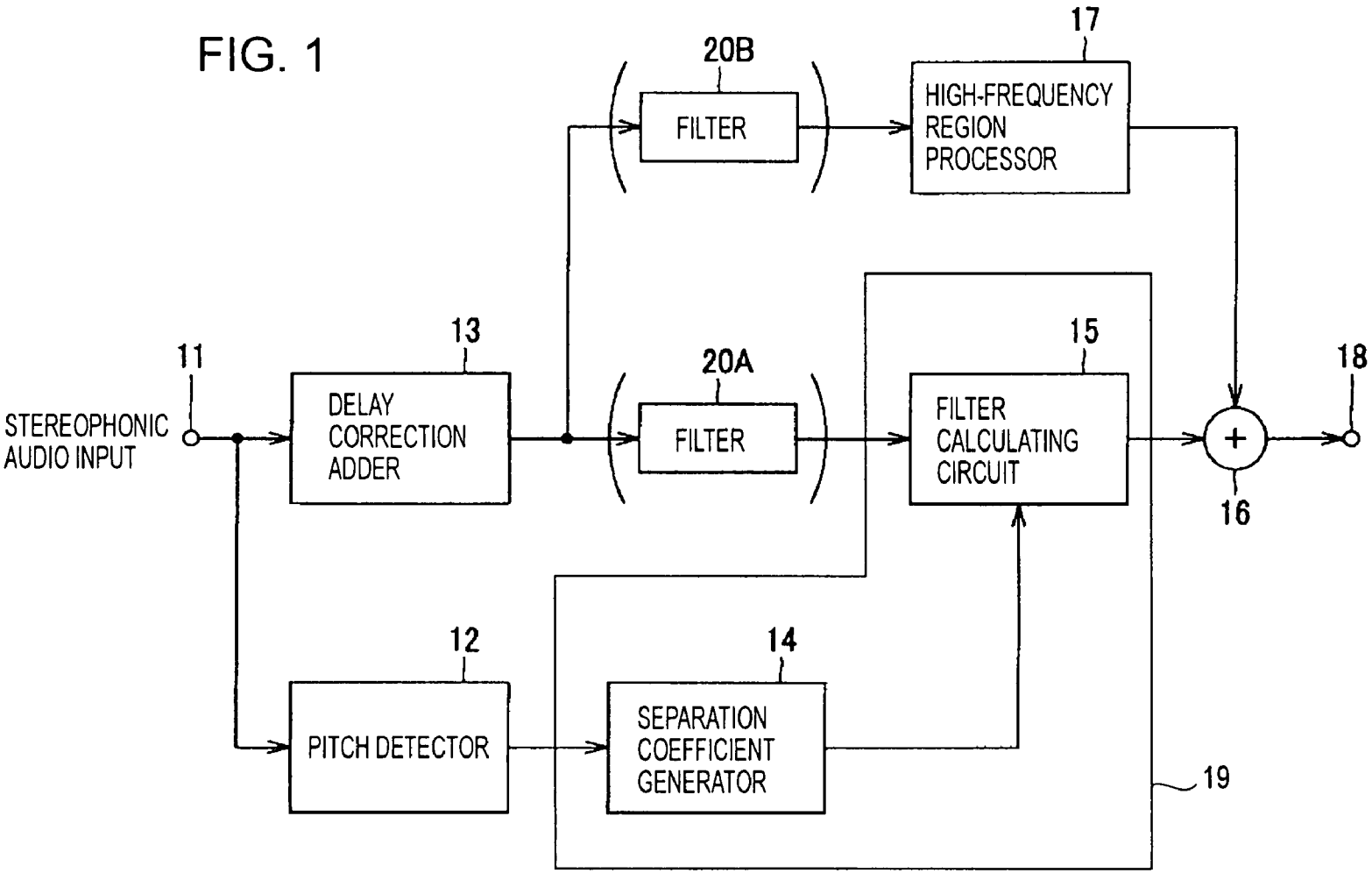
FIG. 1 is a block diagram of a sound-source signal separating apparatus in accordance with one embodiment of the present invention.

FIG. 1 illustrates the structure of a sound-source signal separating apparatus in accordance with one embodiment of the present invention.

As shown in FIG. 1, an input terminal 11 receives an audio signal picked up by microphones, namely, a stereophonic audio signal picked up by stereomicrophones. The audio signal is transferred to a pitch detector 12 and a delay correction adder 13 serving as a sound-source signal enhancing unit for enhancing a target sound-source signal. An output from the pitch detector 12 is supplied to a separation coefficient generator 14 in a sound-source signal separator 19, while an output from the delay correction adder 13 is supplied to a filter calculating circuit 15 in the sound-source signal separator 19, as necessary, via a (low-pass) filter 20A that outputs a frequency component in the medium to lower frequency band. The filter calculating circuit 15 separates a desired target sound. Each time a pitch detected by the pitch detector 12 is updated, the separation coefficient generator 14 serving as separation coefficient output means generates a filter coefficient responsive to the detected pitch, and supplies the generated filter coefficient to the filter calculating circuit 15. The output from the delay correction adder 13 is also sent to a high-frequency region processor 17, as necessary, via a (high-pass) filter 20B that causes a high-frequency component to pass therethrough. The high-frequency region processor 17 processes non-steady waveform signals, such as consonants. The output from the filter calculating circuit 15 and the output from the high-frequency region processor 17 are summed by an adder 16, and the resulting sum is then output from an output terminal 18 as a separated waveform output signal.

In such a sound-source signal separating apparatus, the pitch detector 12 detects the pitch (the degree of highness) of a steady portion of the audio sound where the same or about the same pitch, such as a vowel, continues. The pitch detector 12 outputs the detected pitch and also information indicating the steady portion (for example, coordinate information along a time axis representing a continuous duration of the steady portion) as necessary. The delay correction adder 13 serves as sound-source signal enhancing means for enhancing a target sound-source signal. The delay correction adder 13 adds a time delay to the signal from each of the microphones in accordance with the difference in a propagation delay time from each of the sound sources to each of a plurality of microphones (two microphones in the case of a stereophonic system) and sums the delay corrected signals. The signal from a target sound source is thus strengthened and the signal from the other sound source is attenuated. This process will be discussed in more detail later. The separation coefficient generator 14 generates the filter coefficient to separate the signal from the target sound source in accordance with the pitch detected by the pitch detector 12. The separation coefficient generator 14 also will be discussed in more detail later. The filter calculating circuit 15 performs a filter process on a signal output from the delay correction adder 13 (via the filter 20A as necessary) using the filter coefficient from the separation coefficient generator 14 to separate the sound-source signal from the target sound source. The high-frequency region processor 17 performs a predetermined process on the output, such as a non-steady waveform including a consonant, from the delay correction adder 13 (via the high-pass filter 20B as necessary). The output of the high-frequency region processor 17 is supplied to the adder 16. The adder 16 adds the output from the filter calculating circuit 15 to the output from the high-frequency region processor 17, thereby outputting a separated output signal of the target sound to an output terminal 18.

Figure 2:
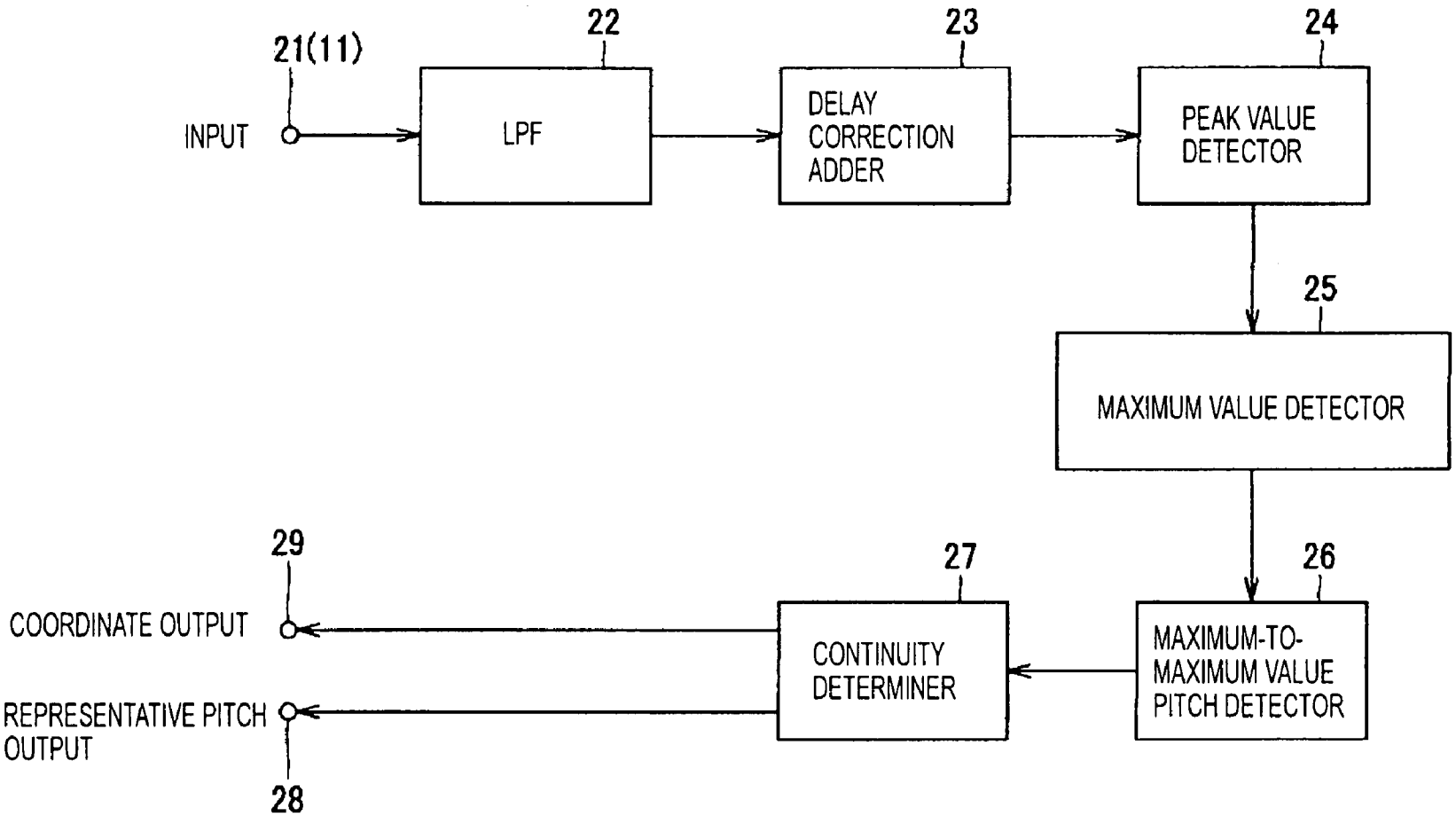
FIG. 2 is a block diagram of a pitch detector in accordance with one embodiment of the present invention.

FIG. 2 illustrates the structure of the pitch detector 12. An input terminal 21, corresponding to the stereophonic audio input 11 of FIG. 1, receives a stereophonic audio input signal picked up by the stereomicrophones. The audio signal is supplied to a delay correction adder 23 via a low-pass filter (LPF) 22 that allows a vowel band where the pitch is steadily repeated to pass therethrough. As will be discussed later, the delay correction adder 23 performs, on the audio signal, a directivity control process for enhancing the signal from the target sound source. The output from the delay correction adder 23 is supplied to a maximum-to-maximum value pitch detector 26 via a peak value detector 24 and a maximum value detector 25 for detecting the maximum value of the peak values between zero crossing points. The output from the maximum-to-maximum value pitch detector 26 is supplied to a continuity determiner 27. A representative pitch output is output from a terminal 28, and a coordinate (time) output representing a duration of steady portion is output from a terminal 29.

Figure 3:
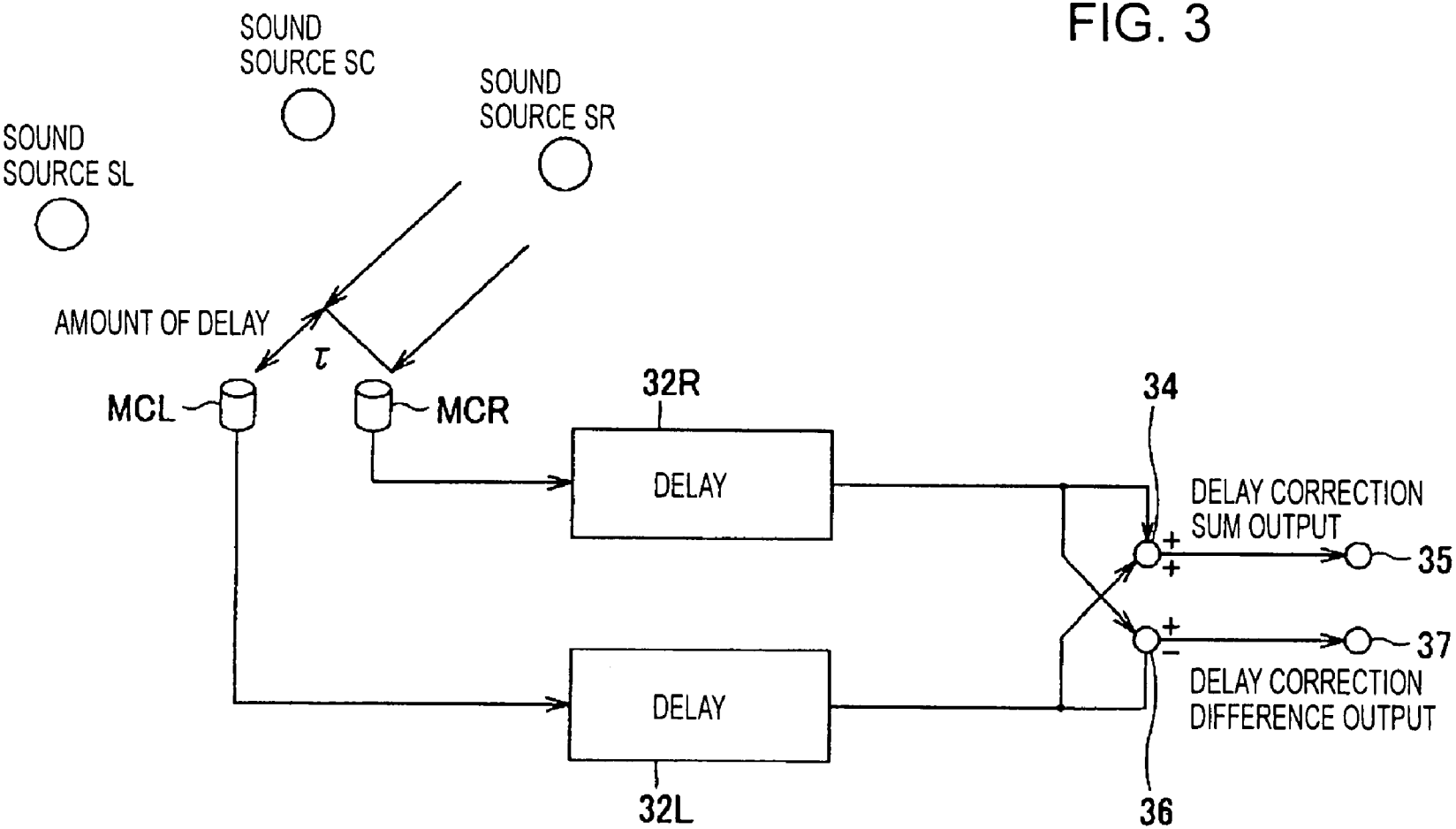
FIG. 3 is a block diagram of a delay correction and summing unit in accordance with one embodiment of the present invention.

The basic structure of the delay correction adder 13 of FIG. 1 and the delay correction adder 23 of FIG. 2 is described below with reference to FIG. 3. As shown in FIG. 3, signals from a left microphone MCL and a right microphone MCR are respectively supplied to delay circuits 32L and 32R, respectively composed of buffer memories, which delay the left and right stereophonic audio signals. In the delay correction adder 23 of FIG. 2, the left and right stereophonic audio signals are passed through the low-pass filter 22 for passing the vowel band therethrough before being supplied to the delay circuits 32L and 32R. The delayed signals from the delay circuits 32R and 32L are summed by an adder 34, and the sum is then output from an output terminal 35 as a delay corrected sum signal. As necessary, the delayed signals from the delay circuits 32R and 32L are subjected to a subtraction process of a subtracter 36, and the resulting difference is output from an output terminal 37 as a delay corrected difference signal.

Figure 4:
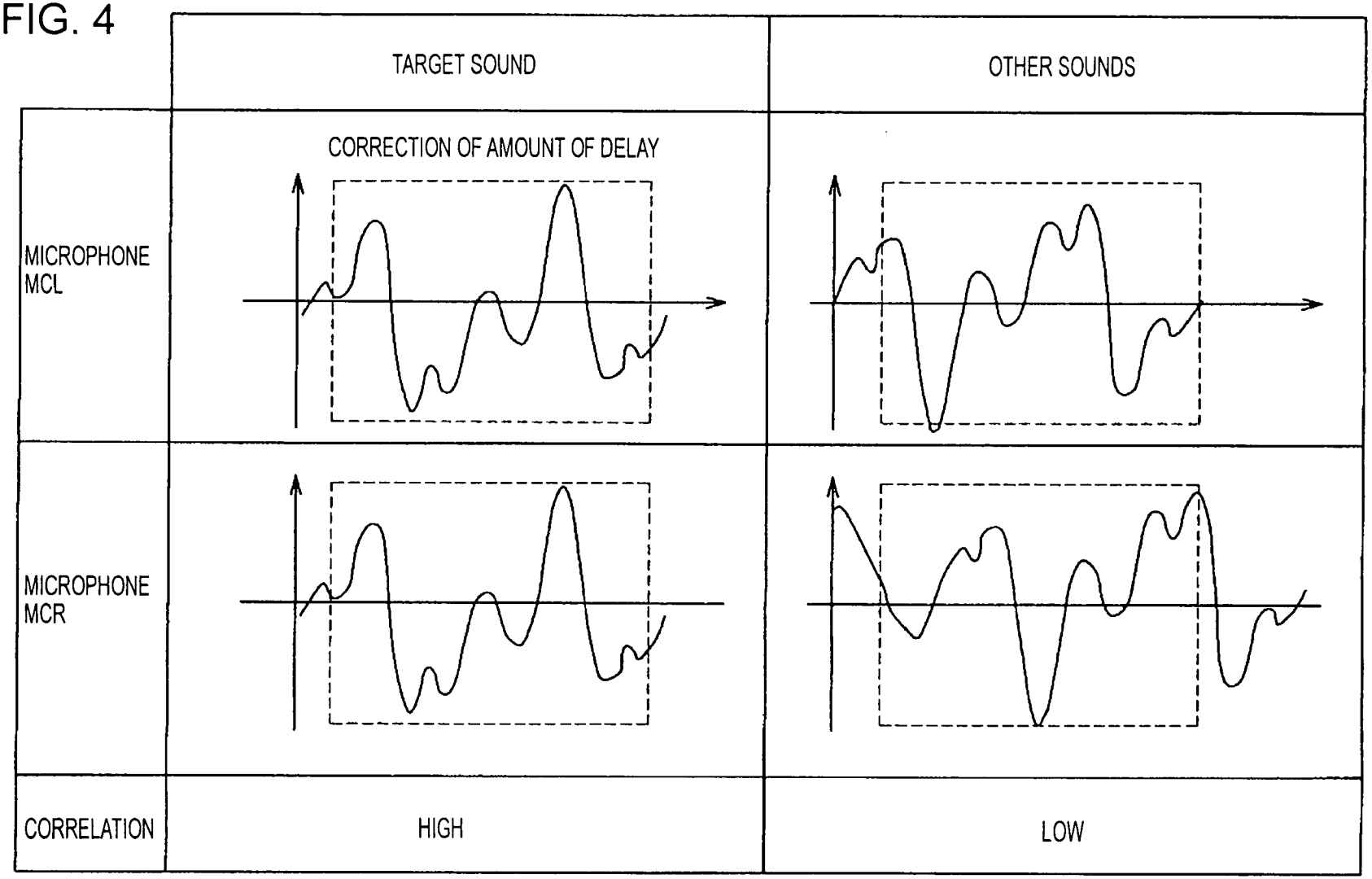
FIG. 4 illustrates an audio signal waveform illustrating the operation of the delay correction and summing unit of the embodiment of the present invention.

The delay correction adder having the structure of FIG. 3 enhances the audio signal from the target sound to extract the audio signal, while attenuating the other signal components. As shown in FIG. 3, a left sound source SL, a center sound source SC, and a right sound source SR are arranged with respect to the stereomicrophones MCL and MCR. The right sound source SR is set to be a target sound source. When a sound is emitted from the right sound source SR, the microphone MCL farther from the right sound source SR picks up the sound with a delay time τ because of a sound propagation delay in the air in comparison with the microphone MCR closer to the right sound source SR. The amount of delay in the delay circuit 32L is set to be longer than the amount of delay in the delay circuit 32R by time τ. As shown in FIG. 4, delay corrected output signals from the delay circuits 32L and 32R result in a higher correlation factor in connection with the target sound from the right sound source SR (to be more in phase). As for the other sounds, the correlation factor is lowered (to be more out of phase). If the center sound source SC is set to be a target source, the sound emitted from the center sound source SC is concurrently picked up by the microphones MCL and MCR (without any delay time involved). The delay times of the delay circuit 32L and the delay circuit 32R are set to be equal to each other, and the correlation factor of the target sound of the center sound source SC is thus heightened while the correlation factor of the other signals are lowered. By adjusting the amounts of delay in each of the delay circuit 32L and the delay circuit 32R, the correlation factor of the sound of only the target sound source is heightened.

The adder 34 sums the delay output signals from the delay circuit 32L and the delay circuit 32R, thereby enhancing only the audio signal having a higher correlation factor. In the vowel portion having a repeated waveform, phase aligned segments are summed for enhancement while phase non-aligned segments are attenuated. The signal with only the target sound intensified or enhanced is thus output from the output terminal 35. When the subtracter 36 performs a subtraction operation to the delayed output signals from the delay circuits 32L and 32R, the phase aligned segments are subtracted one from another, and only the sound from the target sound source is attenuated. A signal with only the target sound attenuated is thus output from the output terminal 37.

The correlation factor is now described. The delay corrected waveform as described above offers a higher degree of waveform match while the other waveform with the phase thereof out of alignment offers a low degree of waveform match. The correlation factor "cor" representing the degree of waveform match is determined using equation (1):

$$cor = \{1/(n-1)S_1S_2\}\sum_{i=1}^{n}(m1_i - \overline{m}1)(m2_i - \overline{m}2) \tag{1}$$

$$S_1^2 = \{1/(n-1)\}\sum_{i=1}^{n}(m1_i - \overline{m}1)^2$$

$$S_2^2 = \{1/(n-1)\}\sum_{i=1}^{n}(m2_i - \overline{m}2)^2$$

$\overline{m}1$ and $\overline{m}2$ represent mean values where m1 and m2 are time samples of the microphones MCL and MCR, and $S_1$ and $S_2$ are standard deviations. Equation (1) determines a correlation factor cor of n pairs of samples ($m1_1$, $m2_1$), ($m1_2$, $m2_2$), . . . , ($m1_n$, $m2_n$).

Figure 5:
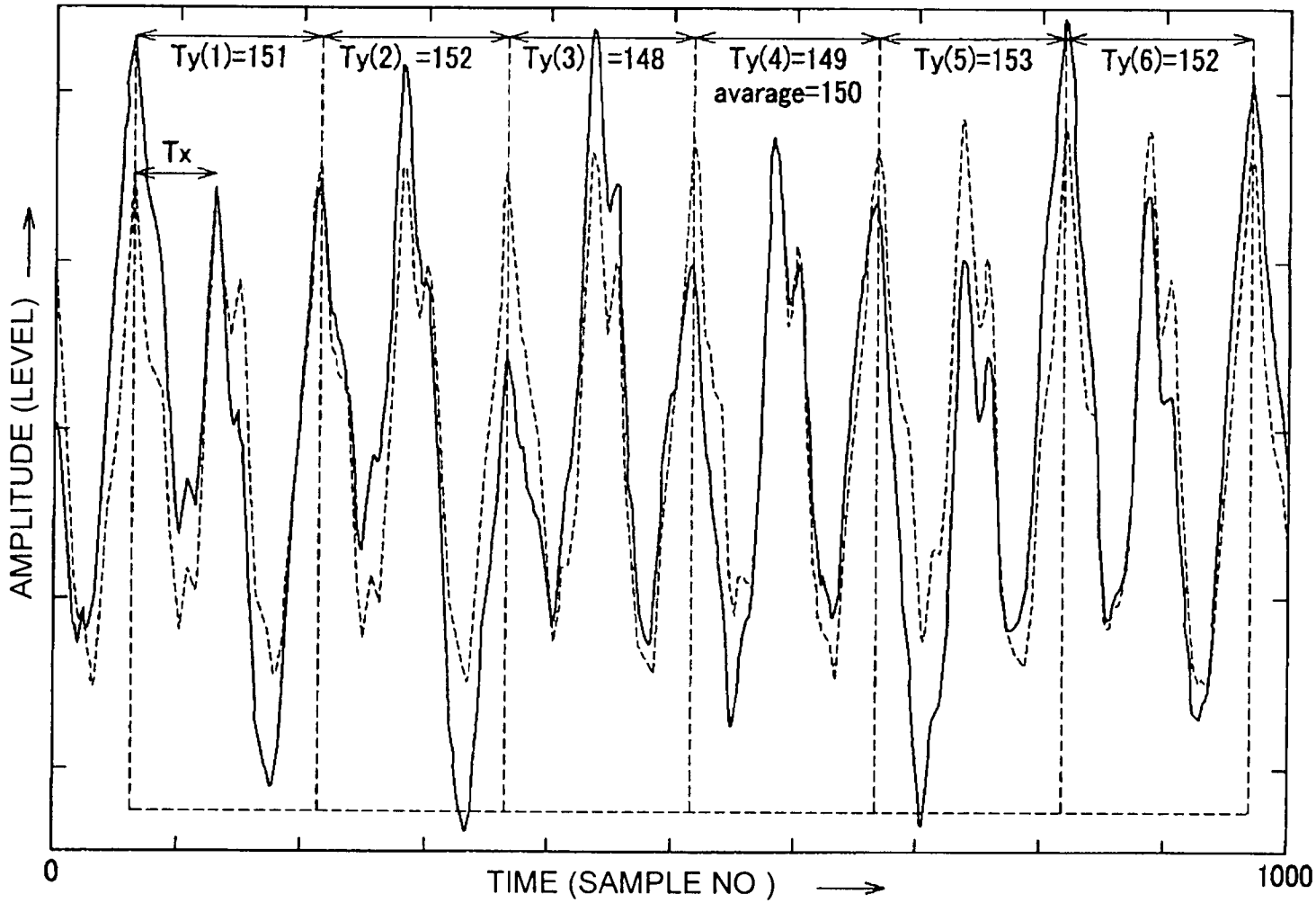
FIG. 5 is a waveform diagram of the audio signal along a time axis in accordance with one embodiment of the present invention.

A pitch detection operation of the pitch detector 12 is described below. FIG. 2 illustrates the structure of the pitch detector 12. The signal from the microphones MCL and MCR is a mixture of the target audio signal and other audio signals as shown in FIG. 5. As shown in FIG. 5, a solid waveform represents an actually obtained signal waveform while a broken waveform represents the signal waveform of the target sound. Even if the directivity control process is performed through the delay correction and summing process to enhance the target sound, the other sounds are still present. The target sound and the other sounds thus coexist. As shown in FIG. 5, the signal waveform of the target sound represented in the broken line is regular with less variations in the amplitude direction (level direction) while the mixed signal waveform represented in the solid line varies in the level direction. A comparison of the mixed signal waveform with the target sound waveform shows no correlation in the level direction, but the mixed signal and the target sound match in peak intervals in the time direction.

Figure 6:
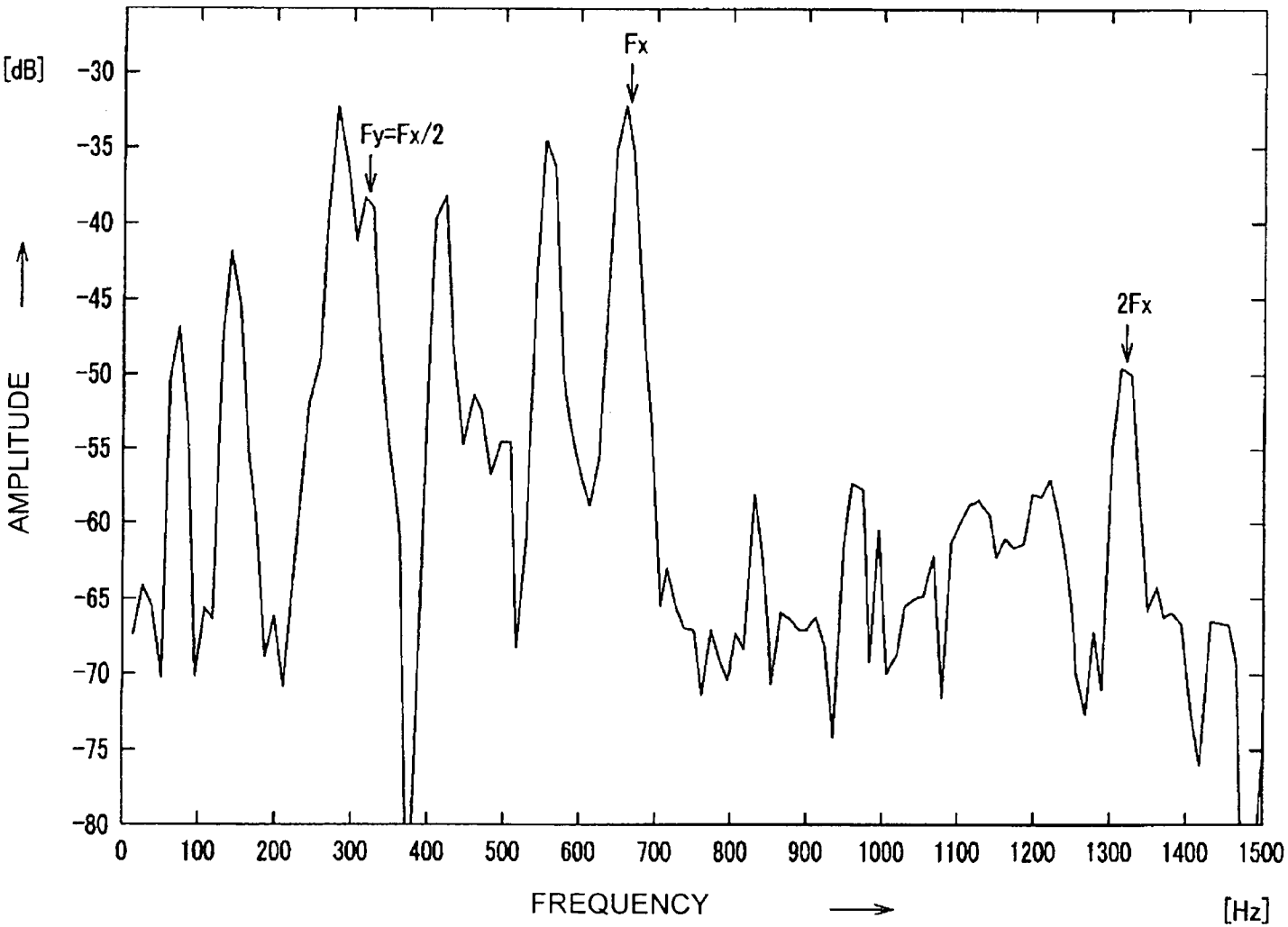
FIG. 6 illustrates a spectrum of the audio signal of FIG. 5 along a frequency axis.

If the signal waveform of FIG. 5 is plotted in spectrum, the plot of FIG. 6 results. The audio signal contains harmonics of a fundamental frequency Fx. The fundamental signal Fx corresponds to a pitch representing the highness of a sound, and is also referred to as a pitch frequency. If the duration between two adjacent peaks in the waveform diagram of FIG. 5 is referred to as one period Tx (one wavelength λx), the fundamental signal Fx equals the reciprocal of the period Tx, namely, Fx=1/Tx. As shown in FIG. 6, a peak appears at the location of a frequency 2Fx, twice the pitch frequency Fx, and peaks typically appear at locations of an integer multiple of the frequency Fx.

Figure 7:
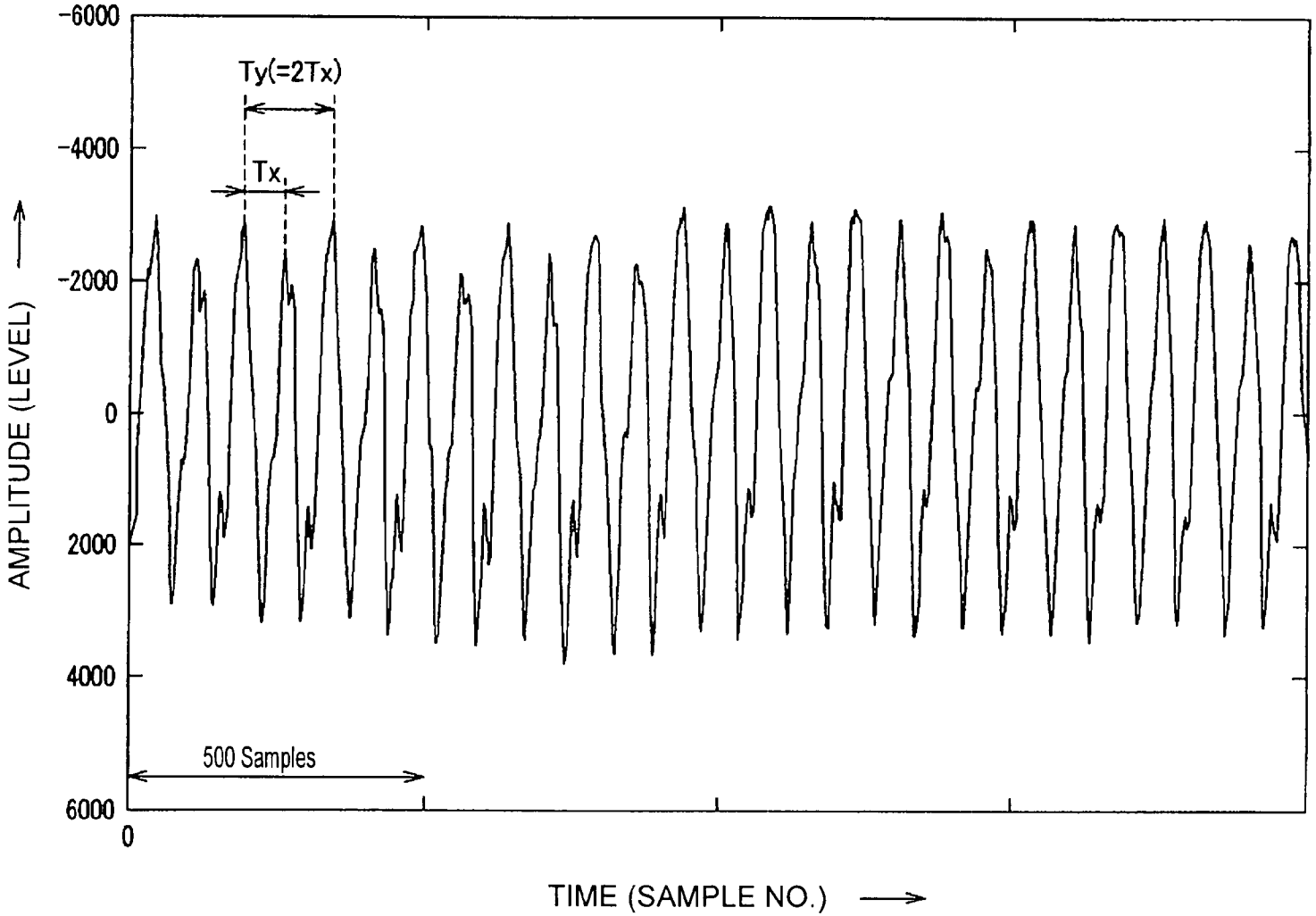
FIG. 7 illustrates a waveform of the audio signal along a time axis with a pitch frequency at about 650 Hz.
Figure 8:
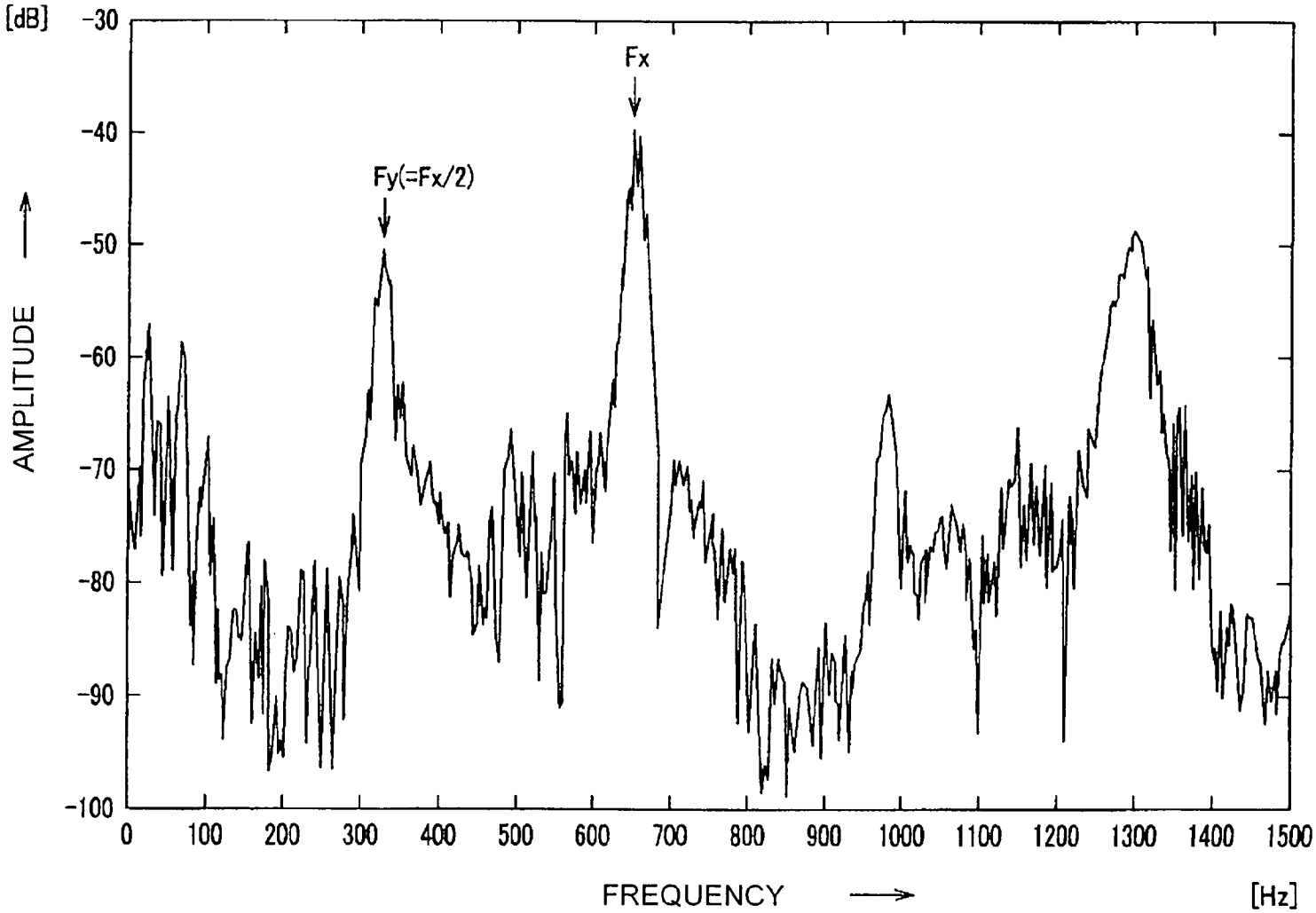
FIG. 8 illustrates a spectrum of the audio signal of FIG. 7 along a frequency axis.
Figure 9:
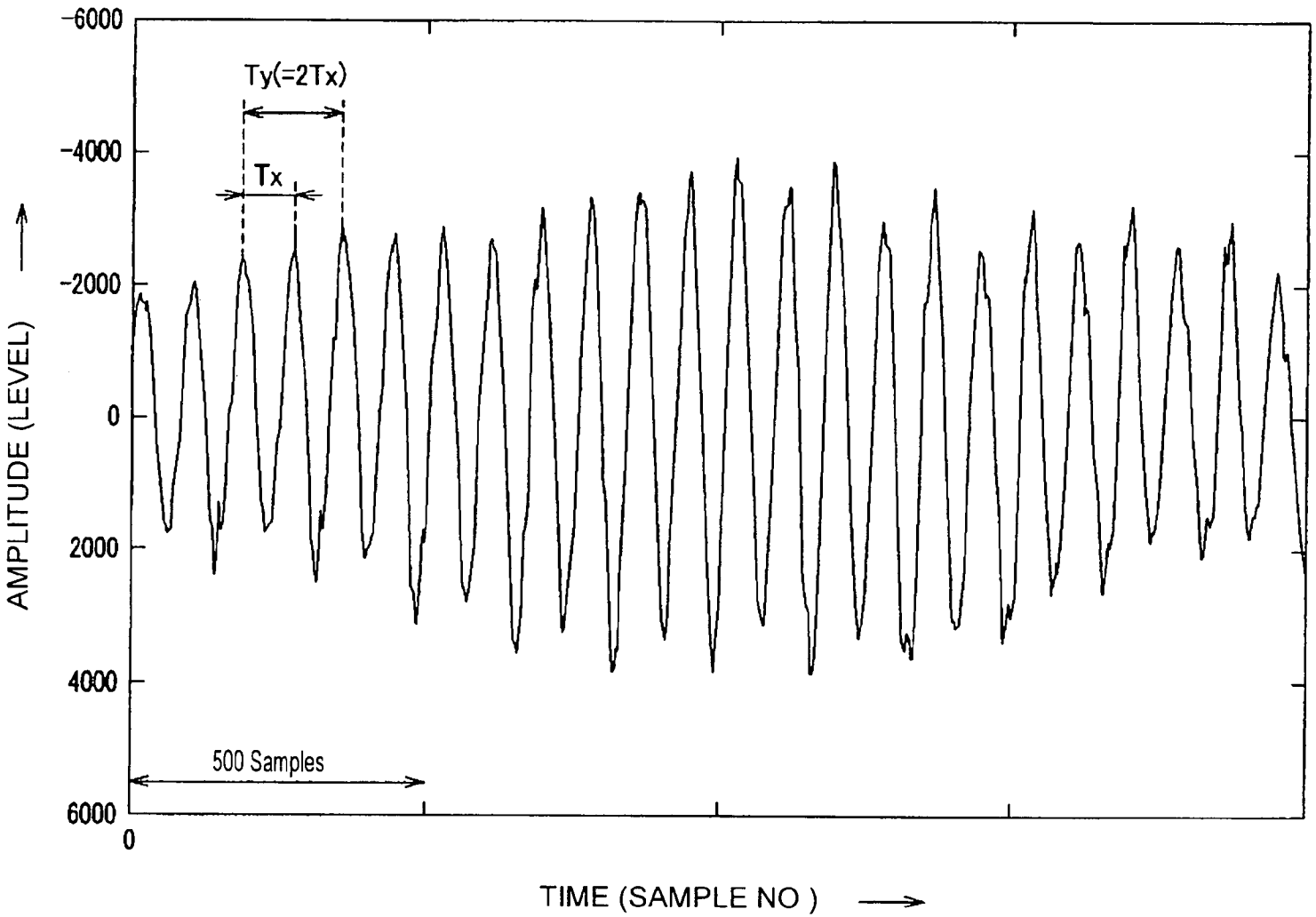
FIG. 9 illustrates a waveform of the audio signal along a time axis with a pitch frequency at about 580 Hz.
Figure 10:
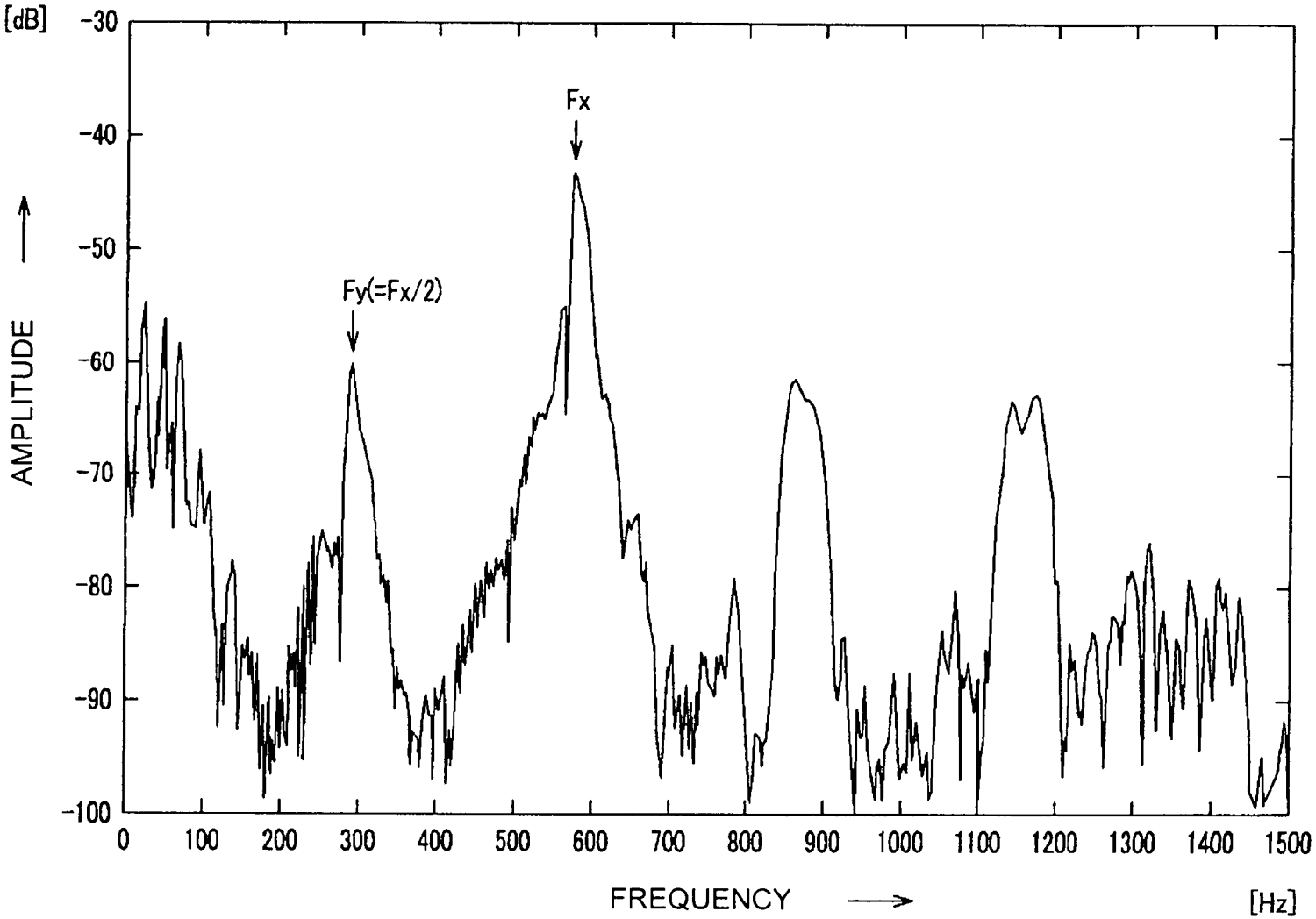
FIG. 10 illustrates a spectrum of the audio signal of FIG. 9 along a frequency axis.

The actual signal waveform contains a wave having a wavelength longer than the pitch period Tx (pitch wavelength λx) corresponding to the duration between the adjacent peak intervals. In particular, a component having a pitch period Ty (=2Tx) twice the pitch period Tx, namely, a component of a frequency Fy (=Fx/2) half the pitch frequency Fx is relatively strong as shown in the spectral diagram of FIG. 6. The component of ½ pitch frequency Fy (=Fx/2) is also relatively strong in ordinary audio signals. For example, the component of half frequency Fy is obviously recognized in the audio signal of a pitch frequency Fx of about 650 Hz as shown in FIGS. 7 and 8, and in the audio signal of a pitch frequency Fx of about 580 Hz as shown in FIGS. 9 and 10. FIGS. 7 and 9 illustrate the audio signals along a time axis and FIGS. 8 and 10 illustrate the spectrum of the audio signals along a frequency axis.

FIGS. 11A-11D show how a component having the pitch frequency Fx is synthesized with a component having the pitch frequency Fy half the pitch frequency Fx. FIG. 11A shows a fundamental waveform (such as a sinusoidal wave)

having the pitch frequency Fx, and FIG. 11B shows a fundamental waveform Fy half the pitch frequency Fx. If the two components are synthesized as shown in FIG. 11C, a variation takes place every two wavelengths. For example, as shown in FIG. 11D, a similar waveform is repeated every two wavelengths. If the interval between two adjacent peaks is set as the period, variations appear alternately, making a stable pitch detection difficult.

In accordance with one embodiment of the present invention, a period Ty twice the period Tx between peaks (pitch wavelength λx) is used as a unit in the pitch detection. If the peak is detected every two wavelengths, the pitch detection is performed at each peak having a similar shape, and the error tends to become smaller. Even if the timing of the start of the pitch detection is shifted by one wavelength, the results are statistically the same. Other integer multiples of wavelengths, such as four wavelengths, six wavelengths, eight wavelengths, . . . , can be used as the peak detection interval. However, if the peak is detected every four wavelengths, for example, the error level is lowered. A disadvantage with the four wavelengths is the increased number of samples.

Figure 12:
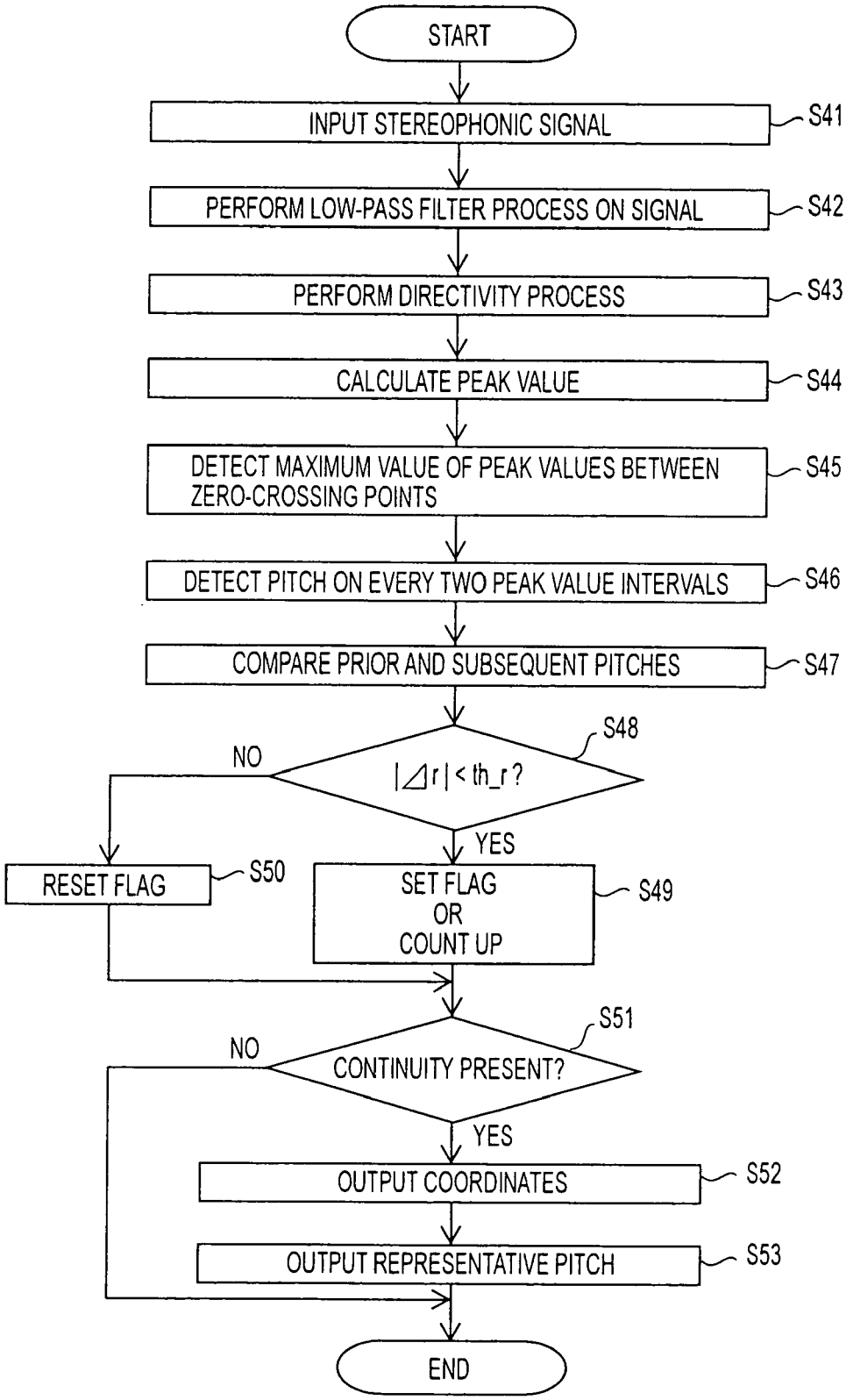
FIG. 12 is a flowchart illustrating a pitch detection process in accordance with one embodiment of the present invention.

The pitch detection operation is described below with reference to FIG. 12. As shown in FIG. 12, a stereophonic audio signal is input in step S41. In step S42, the input signal is low-pass filtered. In step S43, a directivity process is performed in a delay correction and summing operation. These steps correspond to the input from the input terminal 21 (input terminal 11), the process of the LPF 22, and the process of the delay correction adder 23 as shown in FIG. 2.

Figure 13:
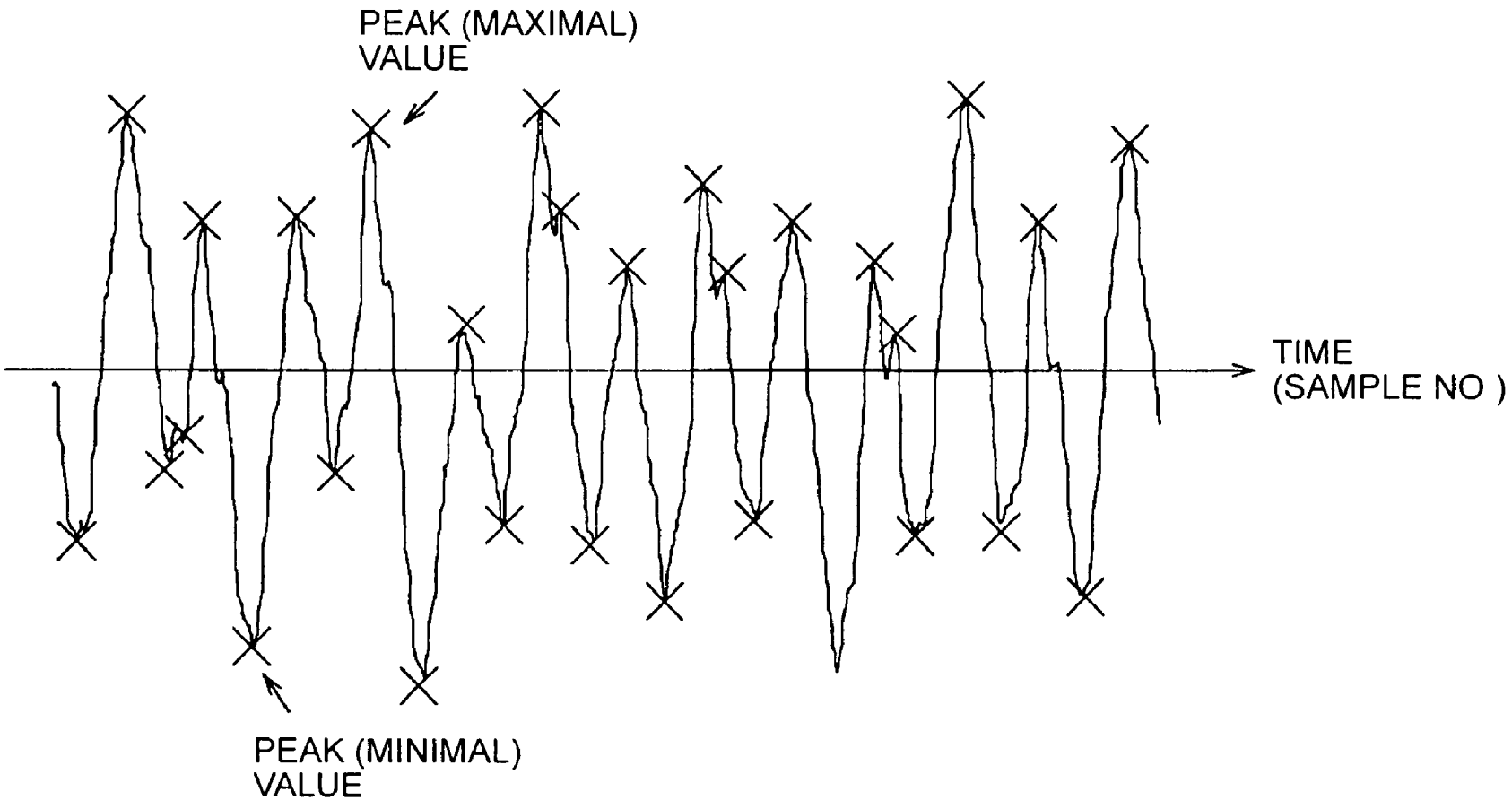
FIG. 13 is a waveform diagram illustrating a maximal peak value and a minimal peak value of the audio signal waveform.

In step S44, the peak value detector 24 detects a maximal peak value. In this step, local peak values represented by the letter X in the waveform diagram of FIG. 13 are determined. Positive peaks (maximal peak values) and negative peaks (minimal peak values) are shown. In this embodiment, the positive peaks (maximal peak values) are used. The positive peaks are determined by detecting a point where the rate of change in the sample value of the signal waveform changes from an increase to a decrease along the time axis. Coordinates (locations) of each sample point of the signal waveform are represented by sample numbers, for example. For example, let d(n) represent a sample value at a sample point "n" (a sample number "n"), and "th" represent a threshold in difference between consecutive sample values along the time axis, and the following equation (2) holds:

$$d(n)-d(n-1)>th \text{ and } d(n+1)-d(n)<-th \quad (2)$$

where the point "n" is a maximal peak point and the sample value at the point "n" is the maximal peak value.

In step S45, the maximum value detector 25 of FIG. 2 detects the maximum value of the maximal peak values between zero-crossing points, determined in step S44, and having a positive value. More specifically, the maximum value detector 25 determines the maximum one of the maximal peak values present within a range from a zero-crossing point where the sample value of the signal waveform changes from negative to positive to a next zero-crossing point where the sample value of the signal waveform changes from positive to negative. The coordinate of the maximum value of the maximal peak values (the location of the sample point and the sample number) between the zero-crossing points is recorded.

In step S46, the maximum-to-maximum value pitch detector 26 detects an interval between a first maximum value and a second maximum value of the maximal peak values, detected in step S45, namely, a pitch of every two maximum values (equal to two wavelengths). In other words, the pitch detection is performed every two wavelengths. Pitch detection means detection of the period Ty (=2Tx). The detected period Ty (or the frequency Fy=1/Ty) is used instead of the original pitch period Tx (or the original pitch frequency Fx). When the coordinate of the sample point of the signal waveform is expressed by the sample number, the period Ty determined in the pitch detection is expressed by the number of samples (the difference between the sample numbers). Let max 1 represent the coordinate (sample number) of the first maximum value and max 3 represent the coordinate of the third maximum value, and the following equation (3) holds:

$$Ty=\max 3-\max 1 \quad (3)$$

Step S47 and the subsequent steps correspond to the process performed by the continuity determiner 27. In step S47, the pitches prior to and subsequent to the pitch detection interval unit are compared to each other. In this case, the pitch period Tx can be determined from Ty/2. Alternatively, the period Ty detected in the pitch detection process can be used as is. The ratio "r" of the pitch (or the period Ty) of one pitch detection unit to that of a next pitch detection unit is determined. For example, the period Ty of the two wavelengths is used, and let Ty(n) represent the two wavelength period of the current pitch detection unit "n", and the pitch ratio r (here the ratio of the period Ty) is expressed by the following equation (4):

$$r(n)=Ty(n)/Ty(n-1) \quad (4)$$

FIG. 14 is a table listing the results of the pitch detection process performed on the signal waveform of FIG. 5. As shown in FIG. 14, the two-wavelength period is successively detected from a first pitch detection unit. The detected periods are represented as Ty(1), Ty(2), Ty(3), . . . . The table lists the period Ty having the two wavelengths detected in each pitch detection unit represented by the number of samples, the ratio "r", and a continuity determination flag to be discussed later.

In step S48, a steady portion having stable pitch ratios "r" (the ratio of the period Ty), from among those determined in step S47, is determined. It is determined in step S48 whether the absolute value |Δr| (=|1−r|) of a rate of change of the ratio "r" is smaller than a predetermined threshold th_r. If it is determined that the absolute value |Δr| is smaller than the threshold th_r (i.e., yes), processing proceeds to step S49. The continuity determination flag is set (to 1), or a counter for counting the steady portions having stable pitches is counted up. If it is determined in step S48 that the absolute value |Δr| of the rate of change of the ratio "r" is larger than or equal to the threshold th_r (i.e., no), processing proceeds to step S50. The continuity determination flag is reset (to 0). The predetermined threshold th_r is 0.05, for example. As shown in FIG. 14, in the detection unit where Ty(2) is detected, the ratio "r" is 1.00, and the absolute value |Δr| is 0. The flag is thus 1. In the detection unit where Ty(3) is detected, the ratio "r" is 0.97, and the absolute value |Δr| is 0.03, and thus the flag is 1. In the detection unit where Ty(n) is detected, the ratio "r" is 0.7, and the absolute value |Δr| is 0.3, and thus the flag is 0.

In step S51, it is determined whether the detected pitches (or the detected periods Ty) exhibit continuity. If the continuity determination flag, set in step S49, is consecutively counted by five times or more, it is determined that there is continuity. The detected pitch (or the period Ty) is thus determined as being effective. For example, as shown in FIG. 14, since the flag consecutively remains at 1 from the period Ty(2) through the period Ty(6), the detected pitches are effective. A representative pitch, such as a mean value of the pitches at the periods Ty(2) through Ty(6), is thus output.

If it is determined in step S51 that there is continuity (i.e., yes), processing proceeds to step S52. The coordinates (time)

of the steady portion throughout which the same or about the same pitch is repeated on the time axis is output. In step S53, the representative pitch (the mean value of the period Ty within the steady duration) is output, and processing thus ends. If it is determined in step S51 that no continuity is observed (i.e., no), processing ends. By repeating the process shown in FIG. 12, the pitch detection is consecutively performed on the input signal waveform.

In summary, at least two sound sources are handled with respect to the stereomicrophones. To separate the sound emitted from a target person, the pitch of a steady portion of the mixed signal waveform, such as a vowel, is detected. In this case, the highness of the sound, and the sex of the person are not important. If the waveform is not a mixture, the variation in the level direction thereof is retained, and the period of the waveform changes with autocorrelation. In the case a mixed signal, the variation in the level direction is not retained. However, the pitch on the time axis is retained. In accordance with the embodiment of the present invention, the pitch is detected according to a two-wavelength period rather than by detecting the peak-to-peak period. In this way, the pitch detection is performed reliably and accurately. A sound separation process is easily performed later.

The operation of the sound-source signal separating apparatus of FIG. 1 is described below.

The pitch detector 12 of FIG. 1 can be one that detects the pitch according to the two-wavelength period. The present invention is not limited to such a pitch detector. The pitch detector 12 can detect the pitch according to a one-wavelength period, a four-wavelength period, or a longer wavelength period.

The pitch detector 12 determines the pitch according to the pitch detection unit, and determines the coordinate (sample number) in each continuity duration or steady portion throughout which the same or about the same pitch is repeated. The sound signal separator using the stereomicrophones of FIG. 1 separates the signal waveform from at least two sound sources based on these pieces of information.

The pitch detected by the pitch detector 12 is sent to the separation coefficient generator 14. The separation coefficient generator 14 generates a filter coefficient (separation coefficient) for the filter calculating circuit 15 that separates a target sound. The separation coefficient generator 14 generates the filter coefficient in accordance with a band-pass filter coefficient producing equation (5) with the representative pitch obtained by the pitch detector 12 as a fundamental frequency:

$$h[i] = \sum_{n=0}^{m} \sum_{f=Lo[n]}^{Hi[n]} \sum_{i=0}^{FIRLEN} \cos(2 * Pi * f / FS * (i - HLFLEN)) \tag{5}$$

where h[i] represents a filter coefficient of a tap position "i", FIRLEN is the number of filter taps, HLFLEN is (FIRLEN−1)/2, Pi represents a circular constant π, m represents the number of harmonics, and FS represents a sampling frequency. The sampling frequency FS is 4800 for 48 kHz. Furthermore, Lo[n] and Hi[n] represent bandwidths in frequencies of harmonics, where Lo[n] is for a higher frequency, and Hi[n] is for a lower frequency. Any bandwidth is acceptable, but is typically determined taking into account separation performance. The integer number of harmonics "m" can be max_freq/f[1] if the maximum frequency is max_freq and the fundamental frequency is f[1]. If m=0, f[0]=f[1]/2 applies. The fundamental frequency can be f[0].

Figure 15:
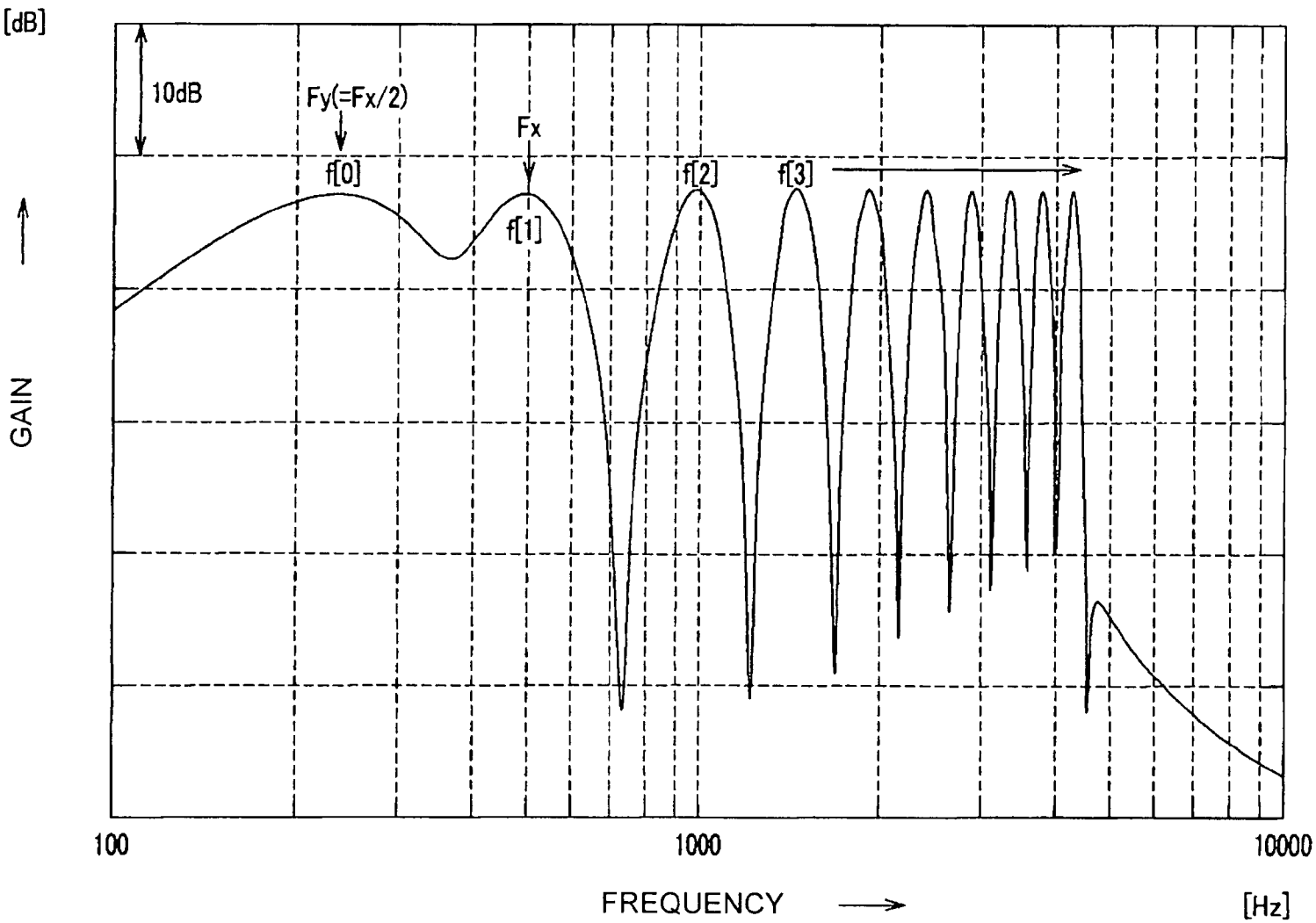
FIG. 15 illustrates frequency characteristics of a separating filter having a filter coefficient produced using a separation coefficient generator.
Figure 16:
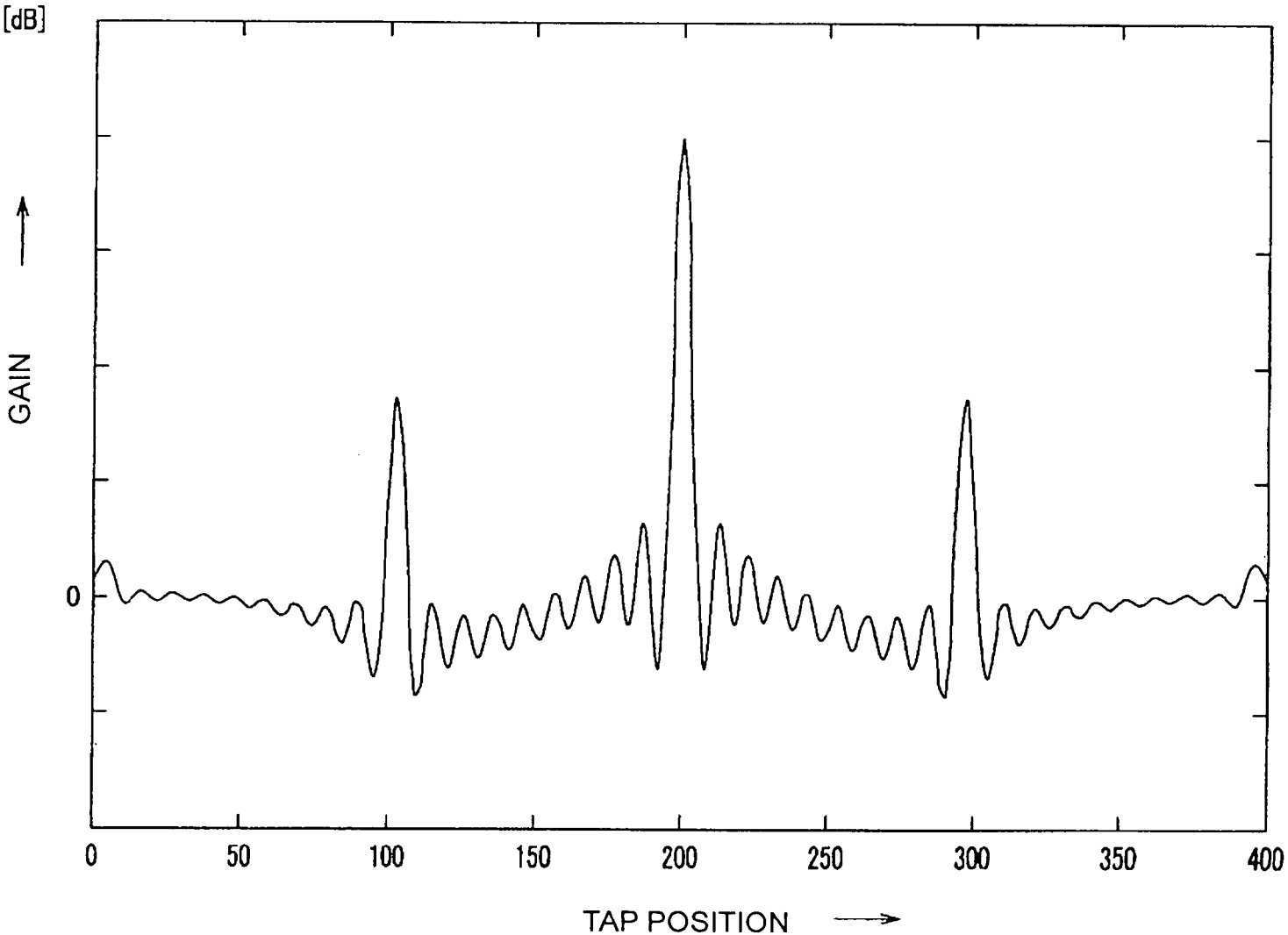
FIG. 16 illustrates a filter coefficient generated by the separation coefficient generator.

FIG. 15 illustrates frequency characteristics of the filter calculating circuit 15 that uses the filter coefficient generated by the separation coefficient generator 14. The filter having the frequency characteristics of FIG. 15 is a so-called comb-like band-pass filter. In such a band-pass filter, the more the number of taps, the steeper the troughs and the peaks become. The narrower the bandwidth, the more the region of each trough expands, and the higher the probability of separation becomes. The band-pass filter coefficient generated in accordance with equation (5) is shown in tap position along the tap axis in FIG. 16. To heighten separation performance, a window function needs to be selected.

The filter calculating circuit 15 handles a middle frequency region and lower frequency regions. Using the filter coefficient generated by the separation coefficient generator 14, the filter calculating circuit 15, like a FIR filter having a multiplication and summing function, separates the target sound containing the detected pitch and the lower frequency component thereof.

A non-steady waveform, such as a consonant, is input to the high-frequency region processor 17. The audio signal is divided into a high-frequency region and medium and low frequency regions because the vowel and the consonant have different vocalization mechanisms. The steadiness is easier to determine if the vowel distributed in the medium and low frequency regions and the consonant distributed in the high-frequency region are processed in different bands. The vowel, generated by periodically vibrating the vocal chords, becomes a steady signal. The consonant is a fricative sound or a plosive sound with the vocal chords not vibrated. The waveform of the consonant tends to become random. If a random waveform is contained in the vowel portion, the random component is noise, thereby adversely affecting the pitch detection. Given the same number of samplings, a higher frequency signal is subject to waveform destruction because the repeatability thereof is poorer than that of a low frequency signal. The pitch detection becomes erratic. For this reason, the audio signal is divided into the high-frequency region and the medium to low frequency regions in the determination of the steadiness to enhance determination precision.

The high-frequency region processor 17 removes a random portion at a high frequency due to a consonant, such as a fricative sound or a plosive sound, normally not occurring in the steady portion of the target sound, namely, the vowel portion.

In voices, high-level consonants are rarely present in the vowel portion. Even if a target sound is separated from a vowel portion of the sound from a plurality of sound sources, the separated sound sounds different from the original target sound when a random high-frequency wave is contained in the vowel portion. The high-frequency region processor 17 lowers the gain for the high-frequency wave in the steady vowel portion so that the high-frequency wave may not be applied to the adder 16. The resulting output thus becomes close to the original target sound.

The output from the filter calculating circuit 15 and the output from the high-frequency region processor 17 are summed by the adder 16. The separated waveform output signal of the target sound is output from the output terminal 18.

The relationship between the stereomicrophones and the sound source (humans) is described below. Although the spacing between the stereomicrophones is not particularly specified, it typically falls within a range from several centimeters to several tens of centimeters if the system is portable. For example, the stereomicrophones mounted on a mobile apparatus, such as a camera integrated VCR (so-called video camera), are used to pick up sounds. Persons, as sound sources, are positioned at three sectors (center, left, and right), each covering several tens of degrees. In this arrangement, the target sound separation is possible regardless of what sector each person is positioned in. The wider the spacing between the stereomicrophones, the more sectors the area is segmented into, taking into consideration the propagation of sounds to the stereomicrophones. More sectors means difficulty in carrying the apparatus. Conversely, the narrower the stereomicrophone spacing, the smaller the number of sectors, (for example three sectors), but the apparatus is easy to carry.

The LPF 22 of FIG. 2 in the pitch detector 12 and the filters 20A and 20B of FIG. 1 may be integrated into a single filter bank. In such an arrangement, the delay correction adder 23 of FIG. 2 is commonly shared by the delay correction adder 13 of FIG. 1, and the output of the delay correction adder 13 is sent to the filter bank to be divided into a low-frequency region for pitch detection, medium to low frequency regions for the separation filter, and a high-frequency region for high-frequency region processing.

Figure 17:
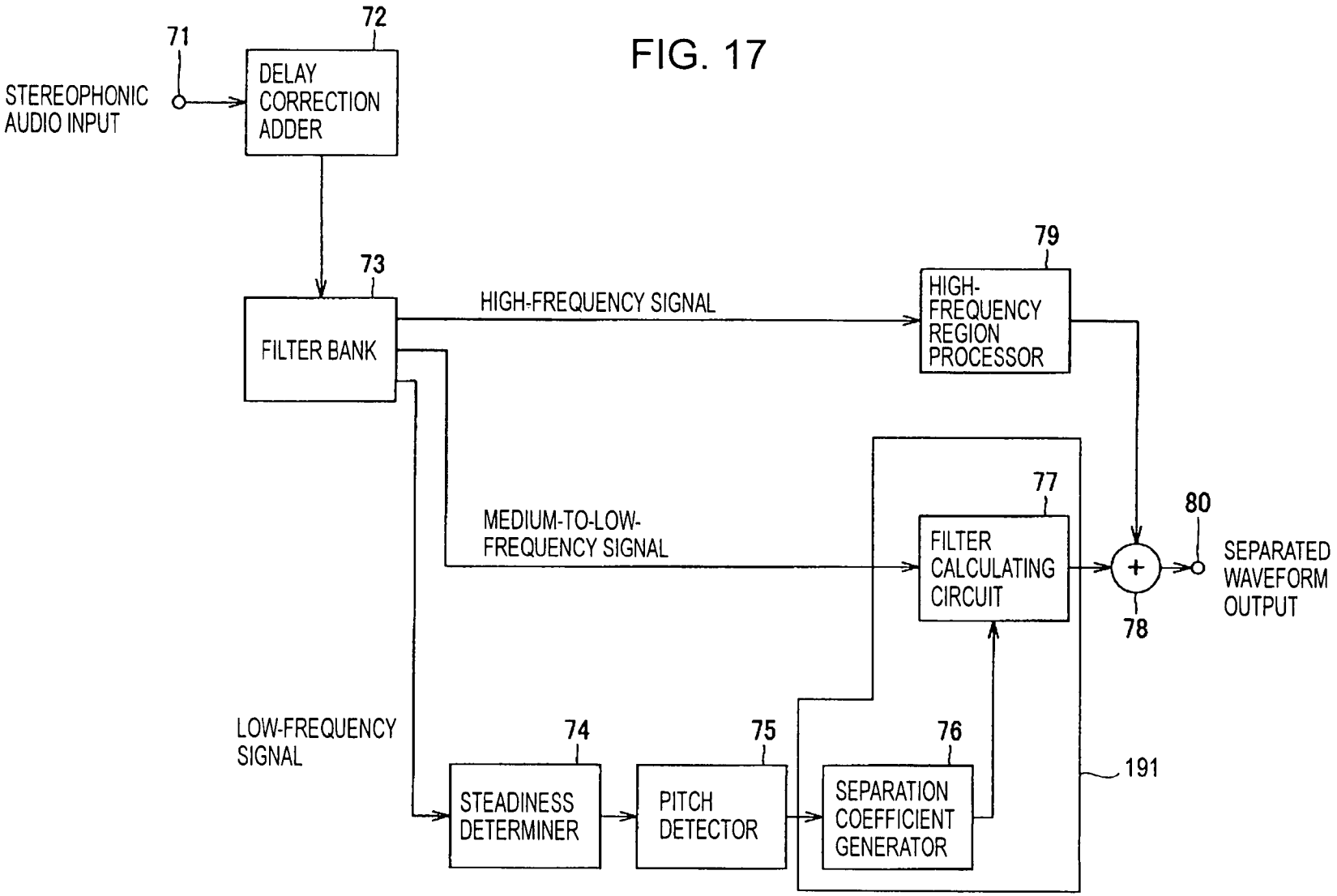
FIG. 17 is a block diagram illustrating a sound-source signal separating apparatus in accordance with one embodiment of the present invention.

FIG. 17 is a block diagram illustrating the sound-source signal separating apparatus using such a filter bank 73.

As shown in FIG. 17, an input terminal 71 receives a stereophonic audio signal picked up by the stereomicrophones, and is sent to a delay correction adder 72 serving as sound-source signal enhancing means for enhancing a target sound-source signal. The delay correction adder 72 can have the same structure as the one previously discussed with reference to FIG. 3. An output from the delay correction adder 72 is supplied to the filter bank 73. The filter bank 73 for dividing a frequency band includes a high-pass filter for outputting a high-frequency component, a low-pass filter outputting a medium-frequency component, and a low-pass filter for outputting a low-frequency component. The high-frequency component refers to a consonant band, and the medium to low frequency components refer to a band other than the consonant band. The low-frequency component refers to a frequency band lower than the medium frequency band. The low-frequency signal, out of the signals in the bands divided by the filter bank 73, is transferred to a pitch detector 75 via a steadiness determiner 74. The signal in the medium to low frequency band is transferred to a filter calculating circuit 77, and the high-frequency signal is transferred to the high-frequency region processor 79.

The pitch detector 12 discussed with reference to FIG. 2 includes the low-pass filter, for outputting a low-frequency component, in the delay correction adder 72, the steadiness determiner 74, and the pitch detector 75 of FIG. 17. The delay correction adder 23 of FIG. 2 is moved to a stage prior to the LPF 22, and corresponds to the delay correction adder 72 of FIG. 17. As previously discussed, the steadiness determiner 74 of FIG. 17 determines a steadiness duration within which the same or about the same pitch is consecutively repeated within an error range of several percent or less. If the steadiness duration lasts for a predetermined period of time (for example, if the continuity determination flag is repeated for each two-wavelength detection unit five times or more), the pitches are determined to be effective, and the representative pitch of the pitches is output from the pitch detector 75.

A separation coefficient generator 76 in a sound-source signal separator 191 generates a filter coefficient (separation coefficient) of a filter calculating circuit 77 in accordance with equation (5). The separation coefficient generator 76 is substantially identical to the separation coefficient generator 14 of FIG. 1. The generated filter coefficient is then transferred to the filter calculating circuit 77 in the sound-source signal separator 191. The filter calculating circuit 77 receives medium to low frequency components from the filter bank 73. As with the filter calculating circuit 15 of FIG. 1, the filter calculating circuit 77 separates the audio signal from the target sound source. A high-frequency region processor 79, identical to the high-frequency region processor 17 of FIG. 1, performs a process on a non-steady wave, such as a consonant. An output from the filter calculating circuit 77 and an output from the high-frequency region processor 79 are summed by a an adder 78, and the resulting sum is then output from an output terminal 80 as the separated waveform output.

In this embodiment, the pitch is detected in the steady portion. The voice of a speaking single person typically expands beyond the steadiness determination portion of the mixed waveform on the time axis. The separation filter coefficient is generated each time the pitch is detected. Applying the filter to the steadiness determination area only is not considered to be an efficient process. Using the filter coefficient in the vicinity of the steadiness determination area is preferred to enhance separation performance in the time direction.

Figure 18:
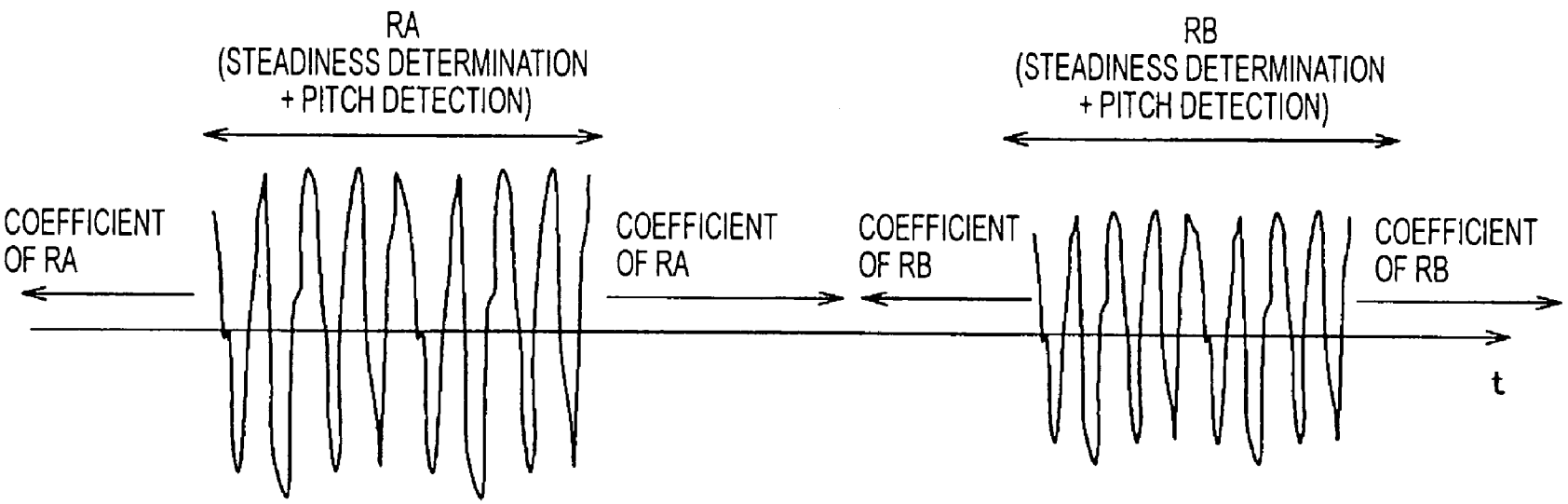
FIG. 18 illustrates a steady portion of a filter coefficient applied in an expanded area along a time axis.

FIG. 18 illustrates two steadiness determination areas detected in the vowel voice. Let RA represent a first steadiness determination area and RB represent a second steadiness determination area. The filter coefficients of the two steadiness determination areas are different from each other. The filter coefficient of the steadiness determination area RA is applied to areas prior to and subsequent to the steadiness determination area RA along the time axis, and the filter coefficient of the steadiness determination area RB is applied to areas prior to and subsequent to the steadiness determination area RB along the time axis. The areas prior to and subsequent to the steadiness determination area can be statistically determined beforehand. For example, if a high-frequency pitch is detected, the time length of the area can be set to be longer or shorter. If a low-frequency pitch is detected, the time length of the area can be set to be shorter or longer.

Figure 19:
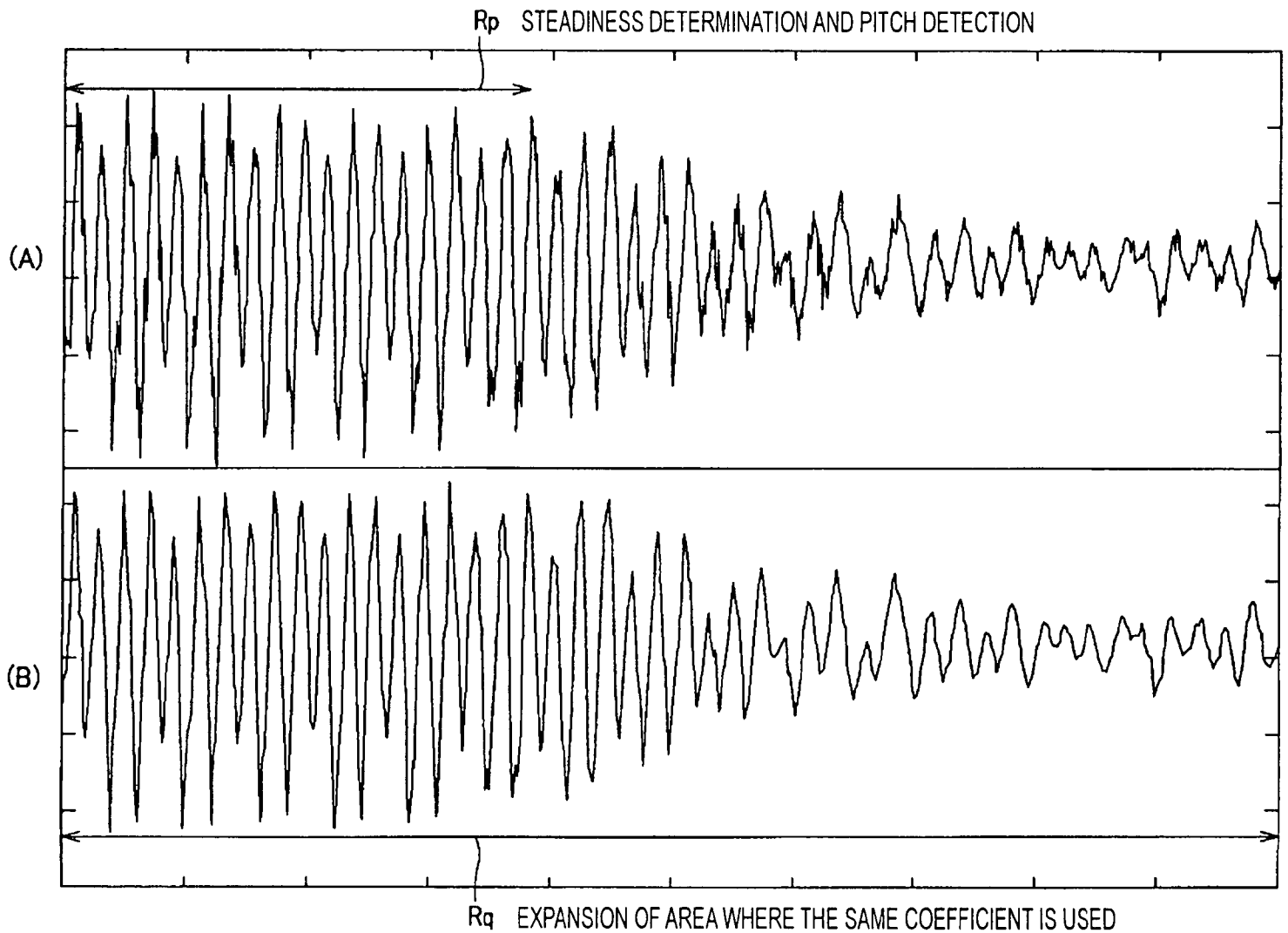
FIG. 19 illustrates a specific signal waveform along a time axis.

FIG. 19 illustrates actual signal waveforms on the time axis. The upper portion (A) of FIG. 19 shows a waveform prior to filtering. A fundamental frequency, namely, a steadiness determination area and a representative pitch, is detected in a range Rp represented by an arrow-headed line. The lower portion (B) of FIG. 19 illustrates a waveform filtered through a band-pass filter that is produced with respect to the pitch. The same coefficient is used in an expanded range Rq represented by an arrow-headed line.

If all harmonic components of the pitch frequency are subjected to the filter to improve separation performance in the separation of the target sound, sounds other than the target sound cannot be attenuated. Using statistical data, some harmonic bands can be excluded from the summing operation.

Another embodiment of the present invention is described below with reference to FIG. 20. The sound-source signal separation apparatus of FIG. 20 includes a speaker determiner 82 and an area designator 83 in addition to the sound-source signal separating apparatus of FIG. 17. As separation coefficient output means, the sound-source signal separation apparatus includes a coefficient memory and coefficient selection unit 86 in the sound-source signal separator 192, instead of the separation coefficient generator 76 in the sound-source signal separator 191 of FIG. 17.

Figure 20:
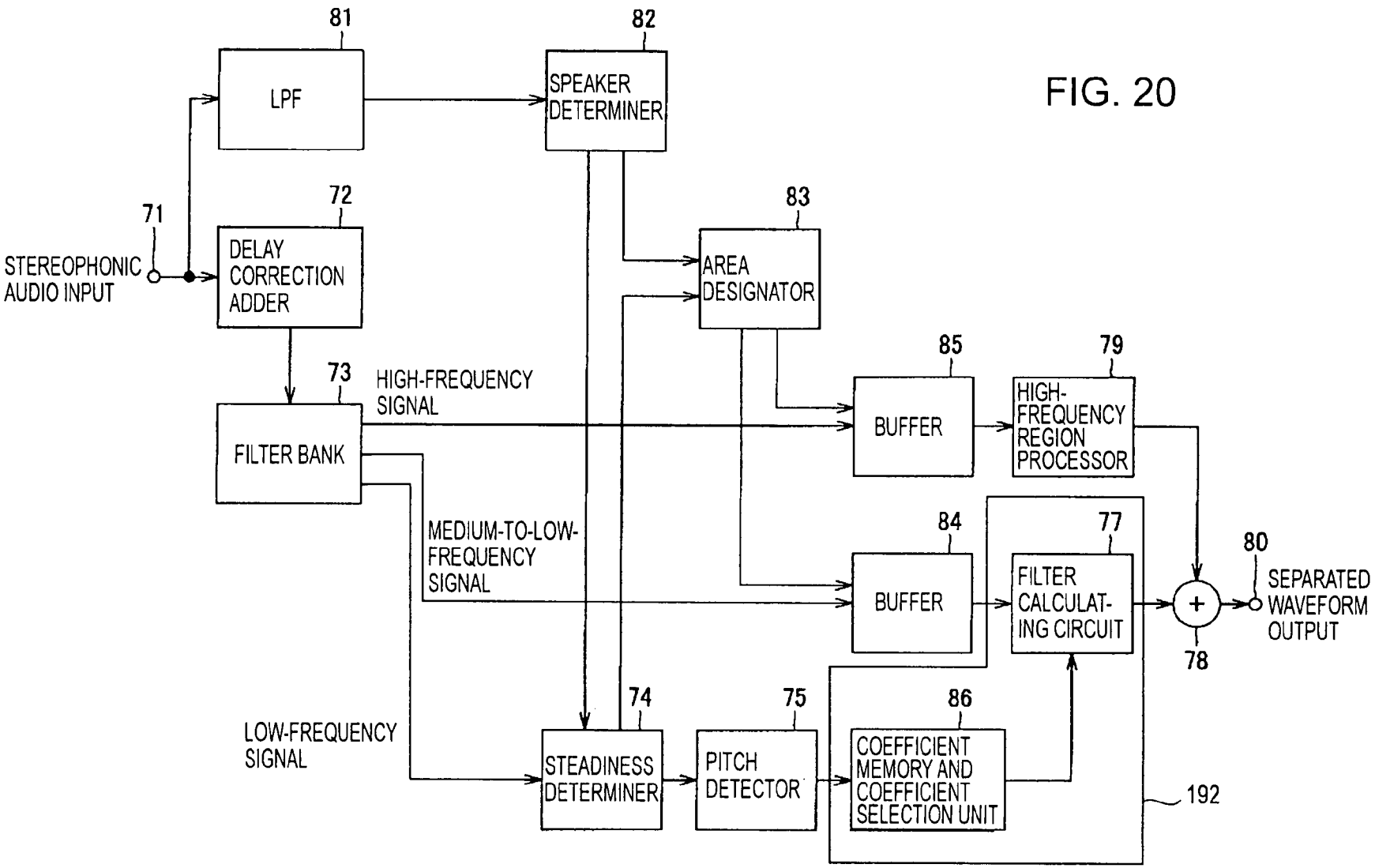
FIG. 20 is a block diagram illustrating another sound-source signal separating apparatus in accordance with one embodiment of the present invention.

The coefficient memory and coefficient selection unit 86 of FIG. 20 as the separation coefficient output means stores, in a memory, separation filter coefficients generated beforehand in response to several pitches, and reads a separation filter coefficient responsive to a detected pitch. For example, pitch values are divided into a plurality of zones, a separation filter coefficient is generated beforehand for a representative value of each zone, the separation filter coefficients for the zones are stored in the memory, and the separation filter coefficient corresponding to the zone within which the pitch detected in the pitch detection falls is read from the memory. In this way, the sound-source signal separating apparatus is freed from the generation of the separation filter coefficient for each detected pitch through calculation. Instead, by accessing the memory, the sound-source signal separating apparatus can quickly acquire the separation filter coefficient. The process is thus speeded up.

Figure 21A:
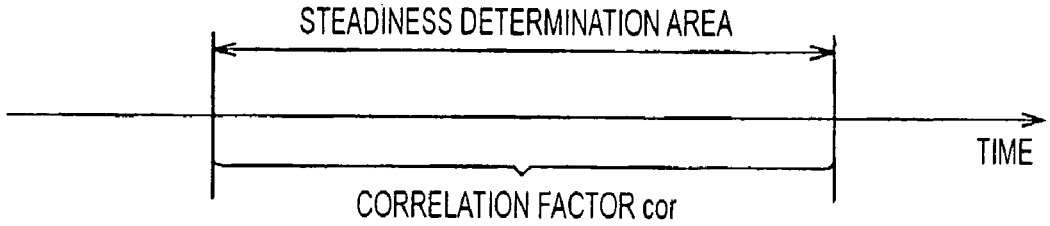
FIGS. 21A-21C illustrate the relationship between a steadiness determination area and speaker determination.
Figure 21B:
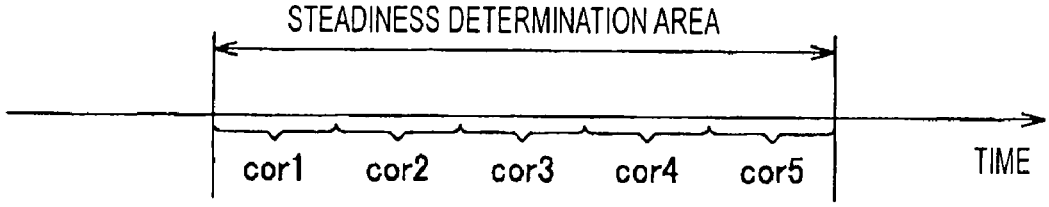
Figure 21C:
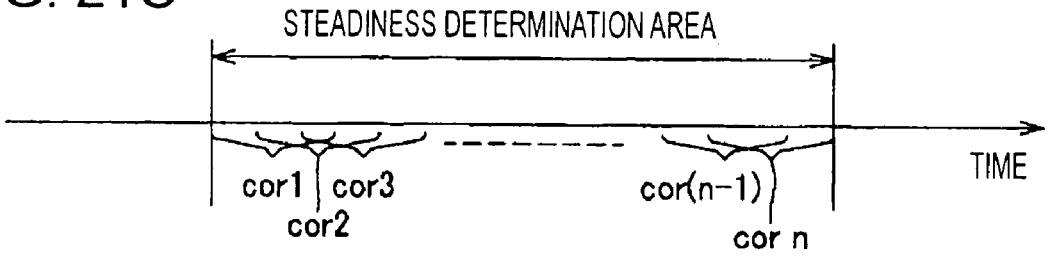

In a speaker determination, the voice of a target person is identified from among a plurality of persons (sound sources). The speaker determiner 82 uses a signal waveform obtained through the LPF 81. The low-frequency signal obtained via the LPF 81 is a signal falling within the same low band provided by the filter bank 73 in the pitch detection. In the speaker determination, a correlation is determined based on the output from the delay correction adder 13 of FIGS. 1 and 3 and a correlation factor cor discussed with reference to equation (1) to determine whether the target person is speaking. More specifically, as shown in FIG. 21A, the speaker determination can be performed based on the threshold of the correlation value of the entire steadiness determination area as a steady duration. As shown in FIG. 21B, the speaker determination can be performed by segmenting the steadiness determination area into small segments, and by determining the probability of the occurrence of each correlation value above a predetermined threshold. As shown in FIG. 21C, the speaker determination can be performed by segmenting the steadiness determination area into a plurality of segments in an overlapping manner, and by determining the probability of the occurrence of each correlation value above a predetermined threshold. The correlation can be determined by accounting for the correlation of data characteristic of the waveform. By adjusting an amount of delay in the delay correction addition process, the speaker determination is applied to each direction of a plurality of sound sources (persons), and the speaker is thus identified.

An output from the speaker determiner 82 is transferred to the steadiness determiner 74 and the area designator 83. Upon determining a steady area, the steadiness determiner 74 results in time axis coordinates, and sends the coordinate data to the area designator 83. Upon determining the speaker, the area designator 83 performs a process to expand the steadiness determination area by a certain duration of time, and notifies buffers 84 and 85 of the timing of the expanded steadiness determination area for area adjustment. The buffer 84 is interposed between the filter bank 73 and the filter calculating circuit 77 in the sound-source signal separator 192, and the buffer 85 is interposed between the filter bank 73 and the high-frequency region processor 79. For a duration of time (area) that is determined as being outside the steadiness determination area by the area designator 83, gain is simply lowered. To adjust gain, the same taps as those of the filter calculating circuit 77 are prepared, and the taps other than the center one are set to be zero, and the center tap is set to be a coefficient other than one. To set 1/10, only the center tap is set to be a coefficient of 0.1.

The rest of the sound-source signal separating apparatus of FIG. 20 remains identical in structure to the sound-source signal separating apparatus of FIG. 17. Like elements are designated with like reference numerals, and the discussion thereof is omitted herein.

In summary, at least two sound sources are handled with respect to the stereomicrophones. To separate the sound emitted from a target person, the pitch of the steady duration of the mixed signal waveform, such as a vowel, is detected. In this case, the highness of the sound and the sex of the person are not important. The band-pass coefficient (separation filter coefficient) is determined to obtain transfer characteristics of the target sound with respect to the pitch. The sounds in the band other than a peak along the frequency axis relating to the target sound are thus attenuated. The use of the coefficient memory eliminates the need for calculation of the coefficients.

Figure 22:
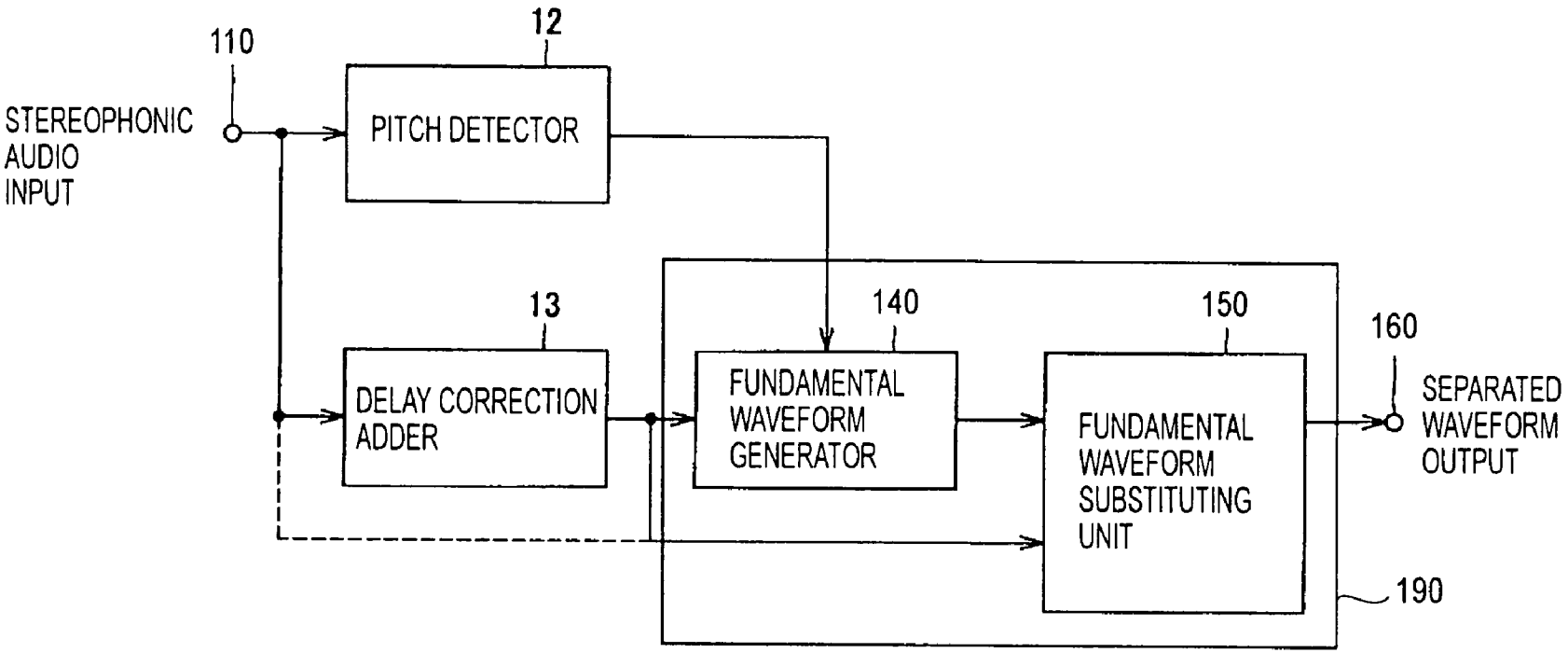
FIG. 22 is a block diagram illustrating the sound-source signal separating apparatus.

FIG. 22 illustrates another sound-source signal separating apparatus in accordance with one embodiment of the present invention.

As shown in FIG. 22, an input terminal 110 receives an audio signal picked up by microphones, namely, stereophonic audio signals picked up by stereomicrophones. The audio signal is then transferred to a pitch detector 12 and a delay correction adder 13 for enhancing a target sound-source signal. An output from the delay correction adder 13 is transferred to a fundamental waveform generator 140 and a fundamental waveform substituting unit 150, both in a sound-source signal separator 190. The fundamental waveform generator 140 generates a fundamental waveform based on a pitch detected by the pitch detector 12. The fundamental waveform is transferred from the fundamental waveform generator 140 to the fundamental waveform substituting unit 150 where the fundamental waveform is substituted for at least a portion of the audio signal from the delay correction adder 13 (for example, a steady portion to be discussed later). The resulting signal is output from an output terminal 160 as a separated waveform output.

In the sound-source signal separating apparatus, the pitch detector 12 and the delay correction adder 13 remain unchanged from the respective counterparts of FIG. 1. Like elements thereof are designated with like reference numerals, and a discussion thereof is omitted herein.

The pitch detector 12 of FIG. 22 can detect the pitch according to the two-wavelength pitch. The present invention is not limited to such a pitch detector. For example, a pitch detector detecting a one-wavelength period or an even-numbered wavelength period, such as a four-wavelength period, can be used. The more the number of wavelengths used in the pitch detection, the more the number of samples to be processed increases, and the less the occurrence of error becomes. Such a pitch detector can be employed not only in the sound-source signal separating apparatus of FIG. 22, but also in a variety of sound-source signal separating apparatuses that separate a sound-source signal by detecting pitches.

The fundamental waveform generator 140 generates a fundamental waveform based on the pitch of the steady portion detected by the pitch detector 12. A waveform having a wavelength equal to an integer multiple of the pitch wavelength is used as a fundamental wave. In this embodiment, a wavelength twice the pitch wavelength is used. The fundamental waveform substituting unit 150 substitutes a repeating waveform of the fundamental waveform generated by the fundamental waveform generator 140 for the steady portion of the audio signal from the delay correction adder 13 (or from the stereophonic audio input 11). The fundamental waveform substituting unit 150 thus outputs, to an output terminal 160, a separated waveform output signal with only the audio signal from the target sound source enhanced.

The operation of the sound-source signal separating apparatus of FIG. 22 is described below.

The pitch detector 12 detects a pitch on a per pitch detection unit basis, and determines a continuous duration throughout which the same or about the same pitch is repeated, or coordinates (sample numbers) of the steady portion of the audio signal. The sound-source signal separating apparatus of FIG. 1 using the stereomicrophones separates signal waveforms of at least two sound sources based on these pieces of information.

As previously discussed, phase matching is performed by performing the delay correction process on the target sound on each microphone, and the phase corrected signals are summed to enhance the target sound. The remaining sounds are attenuated. The signal waveforms in the steady portions are summed with the period equal to the pitch detection unit. The fundamental waveform of the steady portion is thus generated.

Figure 23:
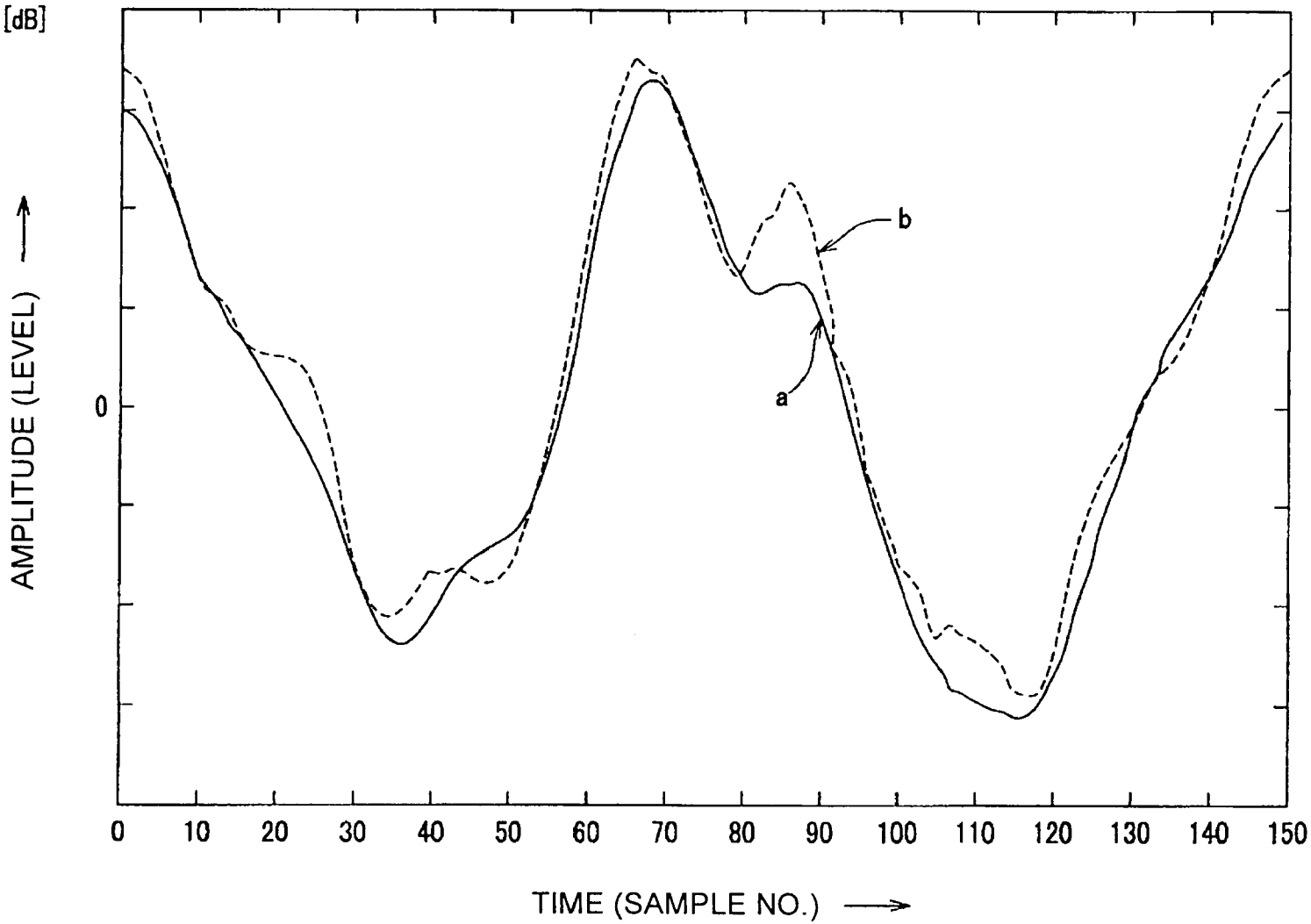
FIG. 23 is a waveform diagram illustrating a fundamental waveform generated by a fundamental waveform generator.

As previously discussed with reference to FIG. 3, the delay correction adder 13 of FIG. 22 performs the delay correction process to remove the difference between the propagation time delays from the target sound source to the microphones, and sums and outputs the resulting signals. The fundamental waveform generator 140 processes an output signal waveform from the delay correction adder 13 in accordance with information from the pitch detector 12 to produce the fundamental waveform. More specifically, the fundamental waveform generator 140 sums the signal waveform within the pitch duration or the steady portion with the period equal to the pitch detection unit in order to generate the fundamental wave. A waveform "a" represented by the solid line in FIG. 23 shows an example of a fundamental wave thus generated. Six waveforms (periods Ty(1)-Ty(6)), each waveform equal to the two wavelengths as shown in FIG. 5, are summed and averaged. A waveform "b" represented by the broken line in FIG. 23 shows an original target sound. As shown in FIG. 23, the fundamental waveform "a" is generated by summing the signal waveforms in the pitch duration or the steady portion with the period equal to the two wavelengths. The fundamental waveform "a" is a close approximation to the waveform "b" of the original target sound. The target sound is retained or enhanced because the target sound is summed without phase shifting. The other sounds, summed with phase shifted, are subject to attenuation. Preferably, the pitch detection is performed according to a unit of two wavelengths, and the fundamental waveform is also generated according to a unit of two wavelengths. This is because the component having the period Ty longer than the pitch period Tx is retained in the generated fundamental waveform.

Figure 24:
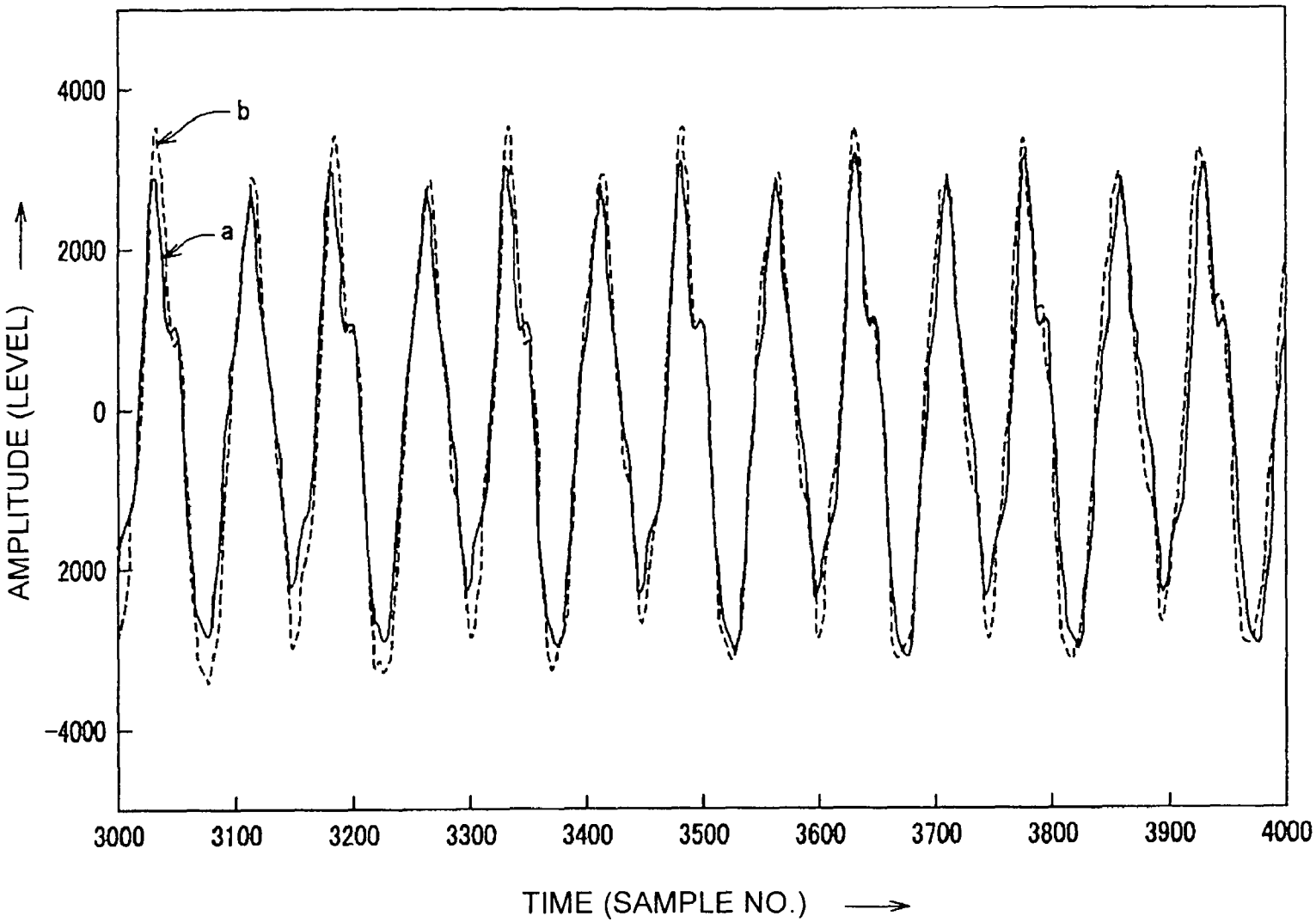
FIG. 24 is a waveform diagram illustrating a repetition of the fundamental waveform substituted for by a fundamental waveform substituting unit.

The fundamental waveform substituting unit 150 substitutes the repetition of the fundamental waveform generated by the fundamental waveform generator 140 for the pitch duration or the steady portion within the output signal waveform from the delay correction adder 13. A waveform "a" represented by the solid line in FIG. 24 shows the repetition of the fundamental waveform substituted by the fundamental waveform substituting unit 150. A waveform "b" represented by the broken line in FIG. 24 shows the waveform of the original target sound for reference.

The output waveform signal from the fundamental waveform substituting unit 150 with the pitch duration or the steady portion substituted for by the fundamental waveform is output from the output terminal 160 as a separated output waveform signal of the target sound.

Figure 25:
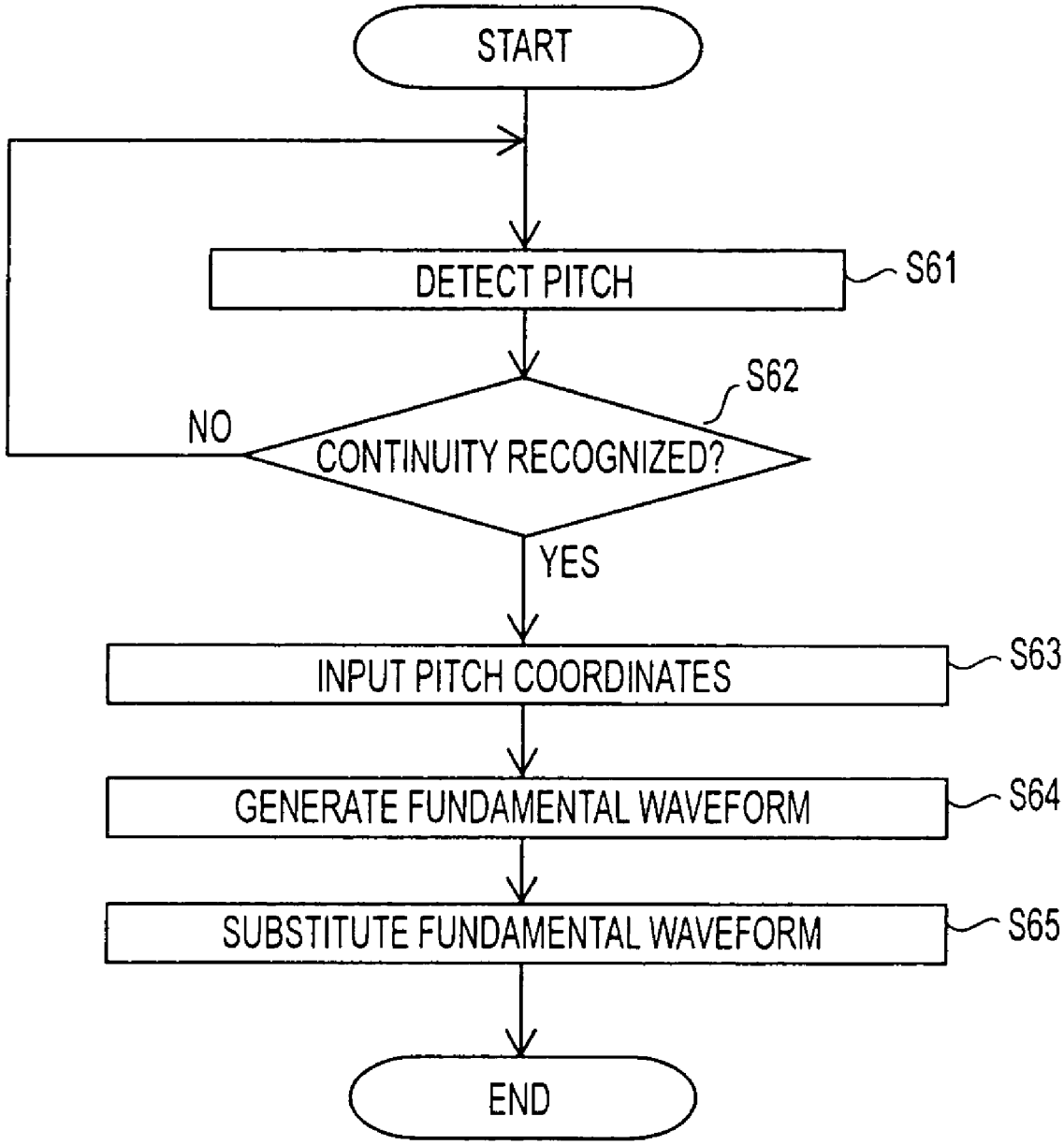
FIG. 25 is a flowchart illustrating a sound-source signal separation process in accordance with one embodiment of the present invention.
Figure 26:
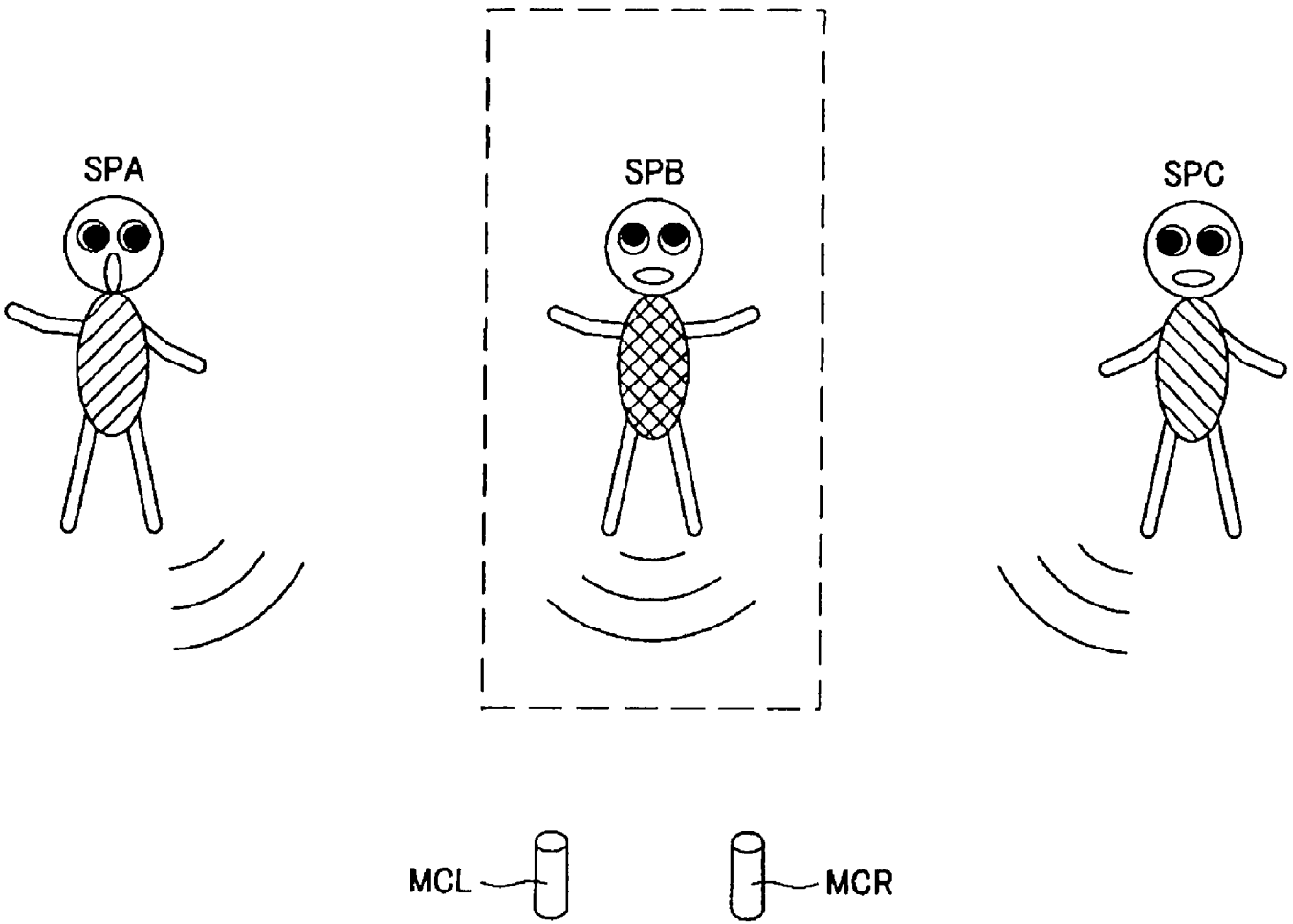
FIG. 26 illustrates a specific example of stereomicrophones with three persons serving as sound sources.

FIG. 25 is a flowchart diagrammatically illustrating the operation of such a sound-source signal separating apparatus. As shown in FIG. 25, the pitch detection is performed with two wavelengths as a unit of detection in step S61. In step S62, it is determined whether continuity is recognized. If it is determined in step S62 that there is no continuity (i.e., no), processing returns to step S61. If it is determined in step S62 that there is continuity (i.e., yes), processing proceeds to step S63. In step S63, the coordinates of a start point and an end point of each pitch detection unit obtained in the pitch detection are input. In step S64, the signal waveforms on each pitch detection unit are summed and averaged to generate the fundamental waveform. In step S65, the fundamental waveform is substituted for the original waveform.

The relationship between the stereomicrophone and the sound source (person) remains unchanged from the preceding embodiment, and the discussion thereof is omitted herein.

In summary, at least two sound sources are handled with respect to the stereomicrophones. To separate the sound emitted from a target person, the pitch of the steady duration of the mixed signal waveform, such as a vowel, is detected. In this case, the highness of the sound and the sex of the person are not important. Continuity is determined to be present if the error between a prior pitch and a subsequent pitch is small. The steady portions are summed and averaged. The resulting waveform is regarded as the fundamental waveform. The fundamental waveform is substituted for the original waveform. As the substituted waveform is summed more, the mixed waveform is attenuated. Only the target sound is enhanced and then separated.

The present invention is not limited to the above-referenced embodiments. The pitch detection may be performed not only with a period of two wavelengths, but with a period of four wavelengths. However, if the pitch detection period is set to be four wavelengths or more, the number of samples to be processed increases. The pitch detection period is thus appropriately set in view of these factors. The arrangement of the pitch detector is applicable to not only the above-referenced sound-source signal separating apparatus but also a variety of sound-source signal separating apparatuses for separating the sound-source signal by detecting the pitch.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A sound-source signal separating apparatus, comprising:

a sound-source signal enhancing unit operable to enhance a target sound-source signal in an input audio signal to produce an enhanced sound-source signal, the input audio signal including a mixture of acoustic signals from a plurality of sound sources picked up by a plurality of sound pickup devices;

a signal processor processing non-steady waveform signals only at a high frequency region in the enhanced sound-source signal by removing random portions from the non-steady waveform signals;

a pitch detector operable to detect a pitch of the target sound-source signal in the input audio signal; and a sound-source signal separating unit operable to process signals at a middle and a lower frequency regions of the enhanced sound-source signal by separating the target sound-source signal from the input audio signal based on the detected pitch and the received middle and lower frequency signals of the enhanced sound-source signal, where information detected by the pitch detector is used to control only the sound-source signal separating unit, and not the signal processor.

2. The sound-source signal separating apparatus according to claim 1, wherein the sound-source signal separating unit comprises:

a filter for separating the target sound-source signal from a signal output from the sound-source signal enhancing unit; and a filter coefficient output unit operable to output a filter coefficient of the filter based on information detected by the pitch detector.

3. The sound-source signal separating apparatus according to claim 2, wherein the filter coefficient features a frequency characteristic of the filter which causes a frequency component to pass through the filter, the frequency component having a frequency which is an integer multiple of the frequency of the pitch of the target sound-source signal.

4. The sound-source signal separating apparatus according to claim 3, wherein the filter coefficient output unit comprises a memory storing filter coefficients corresponding to a plurality of pitches, the filter coefficient output unit reading and outputting a filter coefficient from the memory corresponding to the pitch of the target sound-source signal.

5. The sound-source signal separating apparatus according to claim 2, further comprising:

a high-frequency region processing unit operable to process a portion of the output signal in a consonant band; and a filter bank operable to extract the portion of the output signal in the consonant band from the sound-source signal enhancing unit and to transfer the portion of the output signal in the consonant band to the high-frequency region processing unit, to extract a portion of the output signal in a band other than the consonant band from the sound-source signal enhancing unit and to transfer the portion of the output sound-source signal in the band other than the consonant band to the filter, and to extract a portion of the output signal in a vowel band from the sound-source signal enhancing unit and to transfer the portion of the output signal in the vowel band to the pitch detector.

6. The sound-source signal separating apparatus according to claim 2, wherein the plurality of sound pickup devices comprise a left stereomicrophone and a right stereomicrophone.

7. The sound-source signal separating apparatus according to claim 2, wherein the sound-source signal enhancing unit corrects the acoustic signals from the plurality of sound pickup devices with a time difference between sound propagation delays, each sound propagation delay being measured from a target sound source to each of the plurality of sound pickup devices, and adds the corrected acoustic signals from the plurality of sound pickup devices in order to enhance the acoustic signal from only the target sound source.

8. The sound-source signal separating apparatus according to claim 2, wherein the pitch detector detects the pitch of the target sound-source signal using two wavelengths of the pitch of the target sound-source signal as a unit of detection.

9. The sound-source signal separating apparatus according to claim 1, wherein the sound-source signal separating unit comprises:

a fundamental waveform producing unit operable to produce a fundamental waveform based on information detected by the pitch detector using a steady portion of a signal output from the sound-source signal enhancing unit, the steady portion having at least about the same pitch consecutively repeated throughout; and a fundamental waveform substituting unit operable to substitute a repetition of the fundamental waveform produced by the fundamental waveform producing unit for at least a portion of a signal based on the input audio signal.

10. The sound-source signal separating apparatus according to claim 9, wherein the pitch detector detects the pitch of the target sound-source signal using two wavelengths of the pitch of the target sound-source signal as a unit of detection.

11. The sound-source signal separating apparatus according to claim 9, wherein the plurality of sound pickup devices comprise a left stereomicrophone and a right stereomicrophone.

12. The sound-source signal separating apparatus according to claim 9, wherein the sound-source signal enhancing unit corrects the acoustic signals from the plurality of sound pickup devices with a time difference between sound propagation delays, each sound propagation delay being measured from a target sound source to each of the plurality of sound pickup devices, and adds the corrected acoustic signals from the plurality of sound pickup devices in order to enhance the acoustic signal from only the target sound source.

13. The sound-source signal separating apparatus according to claim 9, wherein the fundamental waveform producing unit averages the target sound-source signal in a steady portion of the target sound-source signal having at least about the same pitch consecutively repeated throughout using two wavelengths of the pitch of the target sound-source signal as a unit of detection.

14. A sound-source signal separating method, comprising:

enhancing a target sound-source signal in an input audio signal to produce an enhanced sound-source signal, the input audio signal including a mixture of acoustic signals from a plurality of sound sources picked up by a plurality of sound pickup devices;

processing non-steady waveform signals only at a high frequency region in the enhanced sound-source signal by removing random portions from the non-steady waveform signals;

detecting a pitch of the target sound-source signal in the input audio signal; and separating the target sound-source signal from the input audio signal based on the detected pitch and the signals at a middle and a lower frequency regions of the enhanced sound-source signal, where information from the detected pitch is used to control only separating the target sound-source signal, not processing at a high frequency region in the enhanced sound-source signal.

* * * * *